US010255792B2

(12) United States Patent
Farrand et al.

(10) Patent No.: US 10,255,792 B2
(45) **Date of Patent: *Apr. 9, 2019**

(54) SECURITY MONITORING AND CONTROL

(71) Applicant: Ooma, Inc., Palo Alto, CA (US)

(72) Inventors: Tobin E. Farrand, Burlingame, CA (US); William M. Gillon, San Mateo, CA (US); Kevin D. Snow, Granite Bay, CA (US); William T. Krein, Loomis, CA (US); David A. Bryan, Cedar Park, TX (US)

(73) Assignee: Ooma, Inc., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/369,655

(22) Filed: Dec. 5, 2016

(65) Prior Publication Data

US 2017/0084164 A1 Mar. 23, 2017

Related U.S. Application Data

(63) Continuation of application No. 14/283,132, filed on May 20, 2014, now Pat. No. 9,633,547.

(51) Int. Cl.
*G08B 26/00* (2006.01)
*G08B 25/00* (2006.01)
(Continued)

(52) U.S. Cl.
CPC ..... *G08B 25/00* (2013.01); *G08B 13/02* (2013.01); *G08B 25/001* (2013.01);
(Continued)

(58) Field of Classification Search
None
See application file for complete search history.

(56) References Cited

U.S. PATENT DOCUMENTS 5,425,085 A 6/1995 Weinberger et al.
5,463,595 A * 10/1995 Rodhall ..... A01M 29/18 340/426.23

(Continued)

FOREIGN PATENT DOCUMENTS

EP 3050287 A1 8/2016
EP 3146516 3/2017

(Continued)

OTHER PUBLICATIONS

Non-Final Office Action, dated Aug. 26, 2008, U.S. Appl. No. 10/888,603, filed Jul. 9, 2004.

(Continued)

*Primary Examiner* — Julie B Lieu
(74) *Attorney, Agent, or Firm* — Carr & Ferrell LLP

(57) ABSTRACT

Systems, methods, and software for monitoring and controlling a security system for a structure are provided herein. An exemplary method may include receiving sensor data from at least one first peripheral, the sensor data associated with at least one of activity inside and activity outside of a structure; determining a critical event based in part on the sensor data; creating an alert based in part on the critical event; getting user preferences associated with at least one of a user and a base unit; determining a response based in part on the alert and user preferences; and activating at least one of a second peripheral and a service based in part on the response.

18 Claims, 13 Drawing Sheets

(51) Int. Cl.

| | |
|---|---|
| ***G08B 13/02*** | (2006.01) |
| ***G08B 25/10*** | (2006.01) |
| ***G08B 25/08*** | (2006.01) |

(52) U.S. Cl.

CPC ..... *G08B 25/006* (2013.01); *G08B 25/008* (2013.01); *G08B 25/08* (2013.01); *G08B 25/10* (2013.01)

(56) References Cited

U.S. PATENT DOCUMENTS 5,519,769 A 5/1996 Weinberger et al.
5,796,736 A 8/1998 Suzuki
6,023,724 A 2/2000 Bhatia et al.
6,377,938 B1 4/2002 Block et al.
6,487,197 B1 11/2002 Elliott
6,594,246 B1 7/2003 Jorgensen
6,615,264 B1 9/2003 Stoltz et al.
6,661,340 B1 12/2003 Saylor et al.
6,697,358 B2 2/2004 Bernstein
6,714,545 B1 3/2004 Hugenberg et al.
6,775,267 B1 8/2004 Kung et al.
6,778,517 B1 8/2004 Lou et al.
6,778,528 B1 8/2004 Blair et al.
6,781,983 B1 8/2004 Armistead
6,914,900 B1 7/2005 Komatsu et al.
6,934,258 B1 8/2005 Smith et al.
7,113,090 B1 9/2006 Saylor et al.
7,124,506 B2 10/2006 Yamanashi et al.
7,127,043 B2 10/2006 Morris
7,127,506 B1 10/2006 Schmidt et al.
7,154,891 B1 12/2006 Callon
7,280,495 B1 10/2007 Zweig et al.
7,295,660 B1 11/2007 Higginbotham et al.
7,342,925 B2 3/2008 Cherchali et al.
7,376,124 B2 5/2008 Lee et al.
7,394,803 B1 7/2008 Petit-Huguenin et al.
7,599,356 B1 10/2009 Barzegar et al.
8,140,392 B2 3/2012 Altberg et al.
8,331,547 B2 12/2012 Smith et al.
8,350,694 B1 1/2013 Trundle et al.
8,515,021 B2 8/2013 Farrand et al.
8,577,000 B1 11/2013 Brown
8,634,520 B1 1/2014 Morrison et al.
8,837,698 B2 9/2014 Altberg et al.
9,147,054 B1 9/2015 Beal et al.
9,225,626 B2 12/2015 Capper et al.
9,386,148 B2 7/2016 Farrand et al.
9,521,069 B2 12/2016 Gillon et al.
9,560,198 B2 1/2017 Farrand et al.
9,667,782 B2 5/2017 Farrand et al.
9,787,611 B2 10/2017 Gillon et al.
9,826,372 B2 11/2017 Jeong
9,905,103 B2 2/2018 Hsieh
9,929,981 B2 3/2018 Gillon et al.
10,116,796 B2 10/2018 Im et al.
10,135,976 B2 11/2018 Farrand et al.
10,158,584 B2 12/2018 Gillon et al.
2001/0053194 A1 12/2001 Johnson
2002/0016718 A1 2/2002 Rothschild et al.
2002/0035556 A1 3/2002 Shah et al.
2002/0037750 A1 3/2002 Hussain et al.
2002/0038167 A1 3/2002 Chirnomas
2002/0085692 A1 7/2002 Katz
2002/0130784 A1 9/2002 Suzuki et al.
2002/0133614 A1 9/2002 Weerahandi et al.
2002/0140549 A1* 10/2002 Tseng ..... B60H 1/00642 340/426.24
2002/0165966 A1 11/2002 Widegren et al.
2003/0027602 A1 2/2003 Han et al.
2003/0058844 A1 3/2003 Sojka et al.
2003/0099334 A1 5/2003 Contractor
2003/0133443 A1 7/2003 Klinker et al.
2003/0141093 A1 7/2003 Tirosh et al.
2003/0164877 A1* 9/2003 Murai ..... G08B 13/19656 348/143
2003/0184436 A1 10/2003 Seales et al.
2003/0189928 A1 10/2003 Xiong
2004/0001512 A1 1/2004 Challener et al.
2004/0010472 A1 1/2004 Hilby et al.
2004/0010569 A1 1/2004 Thomas et al.
2004/0017803 A1 1/2004 Lim et al.
2004/0059821 A1 3/2004 Tang et al.
2004/0086093 A1 5/2004 Schranz
2004/0090968 A1 5/2004 Kimber et al.
2004/0105444 A1 6/2004 Korotin et al.
2004/0160956 A1 8/2004 Hardy et al.
2004/0235509 A1 11/2004 Burritt et al.
2005/0027887 A1 2/2005 Zimler et al.
2005/0036590 A1 2/2005 Pearson et al.
2005/0074114 A1 4/2005 Fotta et al.
2005/0078681 A1 4/2005 Sanuki et al.
2005/0089018 A1 4/2005 Schessel
2005/0097222 A1 5/2005 Jiang et al.
2005/0105708 A1 5/2005 Kouchri et al.
2005/0141485 A1 6/2005 Miyajima et al.
2005/0169247 A1 8/2005 Chen
2005/0222820 A1 10/2005 Chung
2005/0238034 A1 10/2005 Gillespie et al.
2005/0246174 A1 11/2005 DeGolia
2005/0259637 A1 11/2005 Chu et al.
2006/0007915 A1 1/2006 Frame
2006/0009240 A1 1/2006 Katz
2006/0013195 A1 1/2006 Son et al.
2006/0071775 A1 4/2006 Otto et al.
2006/0092011 A1 5/2006 Simon et al.
2006/0114894 A1 6/2006 Cherchali et al.
2006/0140352 A1 6/2006 Morris
2006/0156251 A1 7/2006 Suhail et al.
2006/0167746 A1 7/2006 Zucker
2006/0187898 A1 8/2006 Chou et al.
2006/0187900 A1 8/2006 Akbar
2006/0243797 A1 11/2006 Apte et al.
2006/0251048 A1 11/2006 Yoshino et al.
2006/0258341 A1 11/2006 Miller et al.
2006/0259767 A1 11/2006 Mansz et al.
2006/0268828 A1 11/2006 Yarlagadda
2006/0268848 A1 11/2006 Larsson et al.
2007/0030161 A1 2/2007 Yang
2007/0036314 A1 2/2007 Kloberdans et al.
2007/0037560 A1 2/2007 Yun et al.
2007/0037605 A1 2/2007 Logan
2007/0041517 A1 2/2007 Clarke et al.
2007/0049342 A1 3/2007 Mayer et al.
2007/0054645 A1 3/2007 Pan
2007/0061363 A1 3/2007 Ramer et al.
2007/0061735 A1 3/2007 Hoffberg et al.
2007/0067219 A1 3/2007 Altberg et al.
2007/0071212 A1 3/2007 Quittek et al.
2007/0118750 A1 5/2007 Owen et al.
2007/0121593 A1 5/2007 Vance et al.
2007/0121596 A1 5/2007 Kurapati et al.
2007/0132844 A1 6/2007 Katz
2007/0133757 A1 6/2007 Girouard et al.
2007/0153776 A1 7/2007 Joseph et al.
2007/0165811 A1 7/2007 Reumann et al.
2007/0183407 A1 8/2007 Bennett et al.
2007/0203999 A1 8/2007 Townsley et al.
2007/0223455 A1 9/2007 Chang et al.
2007/0238472 A1 10/2007 Wanless
2007/0255702 A1 11/2007 Orme
2007/0283430 A1 12/2007 Lai et al.
2007/0298772 A1 12/2007 Owens et al.
2008/0049748 A1 2/2008 Bugenhagen et al.
2008/0075248 A1 3/2008 Kim
2008/0075257 A1 3/2008 Nguyen et al.
2008/0084975 A1 4/2008 Schwartz
2008/0089325 A1 4/2008 Sung
2008/0097819 A1 4/2008 Whitman
2008/0111765 A1 5/2008 Kim
2008/0118039 A1 5/2008 Elliot et al.
2008/0125095 A1 5/2008 Mornhineway et al.
2008/0144625 A1 6/2008 Wu et al.

(56) References Cited

U.S. PATENT DOCUMENTS

2008/0144884 A1* 6/2008 Habibi ..... G01C 11/02 382/103
2008/0159515 A1 7/2008 Rines
2008/0168145 A1 7/2008 Wilson
2008/0196099 A1 8/2008 Shastri
2008/0200142 A1 8/2008 Abdel-Kader et al.
2008/0205386 A1 8/2008 Purnadi et al.
2008/0225749 A1 9/2008 Peng et al.
2008/0247401 A1 10/2008 Bhal et al.
2008/0298348 A1 12/2008 Frame et al.
2008/0310599 A1 12/2008 Purnadi et al.
2008/0313297 A1 12/2008 Heron et al.
2008/0316946 A1 12/2008 Capper et al.
2009/0106318 A1 4/2009 Mantripragada et al.
2009/0135008 A1 5/2009 Kirchmeier et al.
2009/0168755 A1 7/2009 Peng et al.
2009/0213999 A1 8/2009 Farrand et al.
2009/0224931 A1 9/2009 Dietz et al.
2009/0240586 A1 9/2009 Ramer et al.
2009/0253428 A1 10/2009 Bhatia et al.
2009/0264093 A1* 10/2009 Rothschild ..... G08B 25/001 455/404.2
2009/0295572 A1 12/2009 Grim, III et al.
2009/0303042 A1* 12/2009 Song ..... G08B 13/19647 340/566
2009/0319271 A1 12/2009 Gross
2010/0034121 A1 2/2010 Bozionek
2010/0046530 A1 2/2010 Hautakorpi et al.
2010/0046731 A1 2/2010 Gisby et al.
2010/0098034 A1 4/2010 Tang et al.
2010/0098058 A1 4/2010 Delangis
2010/0098235 A1 4/2010 Cadiz et al.
2010/0114896 A1 5/2010 Clark et al.
2010/0136982 A1 6/2010 Zabawskyj et al.
2010/0158223 A1 6/2010 Fang et al.
2010/0191829 A1 7/2010 Cagenius
2010/0229452 A1* 9/2010 Suk ..... F41G 1/54 42/146
2010/0277307 A1 11/2010 Horton et al.
2010/0302025 A1 12/2010 Script
2011/0054689 A1* 3/2011 Nielsen ..... G05D 1/0088 700/258
2011/0111728 A1 5/2011 Ferguson et al.
2011/0140868 A1 6/2011 Hovang
2011/0170680 A1 7/2011 Chislett et al.
2011/0183652 A1 7/2011 Eng et al.
2011/0265145 A1 10/2011 Prasad et al.
2012/0010955 A1 1/2012 Ramer et al.
2012/0027191 A1 2/2012 Baril et al.
2012/0035993 A1 2/2012 Nangia
2012/0036576 A1 2/2012 Iyer
2012/0047442 A1 2/2012 Nicolaou et al.
2012/0092158 A1 4/2012 Kumbhar et al.
2012/0099716 A1 4/2012 Rae et al.
2012/0284778 A1 11/2012 Chiou et al.
2012/0320905 A1 12/2012 Ilagan
2012/0329420 A1 12/2012 Zotti et al.
2013/0018509 A1 1/2013 Korus
2013/0035774 A1 2/2013 Warren et al.
2013/0053005 A1 2/2013 Ramer et al.
2013/0070928 A1 3/2013 Ellis et al.
2013/0154822 A1 6/2013 Kumar et al.
2013/0214925 A1 8/2013 Weiss
2013/0267791 A1 10/2013 Halperin et al.
2013/0272219 A1 10/2013 Singh et al.
2013/0288639 A1 10/2013 Varsavsky Waisman-Diamond
2013/0293368 A1 11/2013 Ottah et al.
2013/0336174 A1 12/2013 Rubin et al.
2014/0022915 A1 1/2014 Caron et al.
2014/0084165 A1 3/2014 Fadell et al.
2014/0085093 A1 3/2014 Mittleman et al.
2014/0101082 A1 4/2014 Matsuoka et al.
2014/0120863 A1 5/2014 Ferguson et al.
2014/0169274 A1 6/2014 Kweon et al.
2014/0253326 A1 9/2014 Cho et al.
2014/0266699 A1 9/2014 Poder et al.
2014/0273912 A1 9/2014 Peh et al.
2014/0273979 A1 9/2014 Van Os et al.
2014/0306802 A1 10/2014 Hibbs, Jr.
2014/0334645 A1 11/2014 Yun et al.
2014/0358666 A1 12/2014 Baghaie et al.
2015/0065078 A1 3/2015 Mejia et al.
2015/0071450 A1* 3/2015 Boyden ..... H04R 27/00 381/58
2015/0086001 A1 3/2015 Farrand et al.
2015/0087280 A1 3/2015 Farrand et al.
2015/0100167 A1* 4/2015 Sloo ..... H04L 67/025 700/278
2015/0117624 A1 4/2015 Rosenshine
2015/0138333 A1 5/2015 DeVaul et al.
2015/0145693 A1* 5/2015 Toriumi ..... A61B 5/746 340/870.17
2015/0177114 A1* 6/2015 Kapoor ..... G01B 21/20 702/128
2015/0221207 A1 8/2015 Hagan
2015/0229770 A1 8/2015 Shuman et al.
2015/0244873 A1* 8/2015 Boyden ..... H04R 27/00 379/39
2015/0255071 A1 9/2015 Chiba
2015/0262435 A1* 9/2015 Delong ..... G07C 5/0816 340/439
2015/0281450 A1 10/2015 Shapiro et al.
2015/0302725 A1* 10/2015 Sager ..... H04Q 9/00 340/870.16
2015/0327039 A1 11/2015 Jain
2015/0334227 A1 11/2015 Whitten et al.
2015/0339912 A1 11/2015 Farrand et al.
2015/0379562 A1 12/2015 Spievak et al.
2016/0012702 A1 1/2016 Hart et al.
2016/0036751 A1 2/2016 Ban
2016/0078750 A1* 3/2016 King ..... A61B 5/746 340/506
2016/0117684 A1 4/2016 Khor et al.
2016/0142758 A1* 5/2016 Karp ..... H04N 21/4431 725/25
2016/0173693 A1 6/2016 Spievak et al.
2016/0219150 A1 7/2016 Brown
2016/0248847 A1 8/2016 Saxena et al.
2016/0277573 A1 9/2016 Farrand et al.
2016/0300260 A1 10/2016 Cigich et al.
2016/0323446 A1 11/2016 Farrand et al.
2016/0330108 A1 11/2016 Gillon et al.
2016/0330319 A1 11/2016 Farrand et al.
2016/0373372 A1 12/2016 Gillon et al.
2017/0034044 A1 2/2017 Gillon et al.
2017/0034045 A1 2/2017 Gillon et al.
2017/0034062 A1 2/2017 Gillon et al.
2017/0034081 A1 2/2017 Gillon et al.
2017/0104875 A1 4/2017 Im et al.
2017/0270569 A1 9/2017 Altberg et al.
2017/0293301 A1* 10/2017 Myslinski ..... G05D 1/0088
2018/0061213 A1* 3/2018 Morehead ..... G08B 25/14
2018/0075540 A1* 3/2018 Bernard ..... G06Q 40/08
2018/0262441 A1 9/2018 Gillon et al.
2018/0302334 A1 10/2018 Osterlund et al.
2018/0324105 A1 11/2018 Gillon et al.
2018/0365969 A1 12/2018 Krein et al.

FOREIGN PATENT DOCUMENTS

EP 3167340 5/2017
EP 3295620 3/2018
EP 3050287 12/2018
WO WO2015041738 A1 3/2015
WO WO2015179120 A1 11/2015
WO WO2016007244 A1 1/2016

(56) References Cited

FOREIGN PATENT DOCUMENTS

| | | |
|---|---|---|
| WO | WO2016182796 A1 | 11/2016 |
| WO | WO2018044657 | 3/2018 |

OTHER PUBLICATIONS

Non-Final Office Action, dated May 11, 2009, U.S. Appl. No. 11/717,947, filed Mar. 13, 2007.
Non-Final Officee Action, dated Nov. 24, 2009, U.S. Appl. No. 11/717,947, filed Mar. 13, 2007.
Final Office Action, dated Jun. 23, 2010, U.S. Appl. No. 11/717,947, filed Mar. 13, 2007.
Non-Final Office Action, dated Sep. 13, 2010, U.S. Appl. No. 11/717,947, filed Mar. 13, 2007.
Non-Final Office Action, dated Feb. 16, 2011, U.S. Appl. No. 11/717,947, filed Mar. 13, 2007.
Final Office Action, dated May 25, 2011, U.S. Appl. No. 11/717,947, filed Mar. 13, 2007.
Non-Final Office Action, dated Dec. 6, 2011, U.S. Appl. No. 12/214,756, filed Jun. 20, 2008.
Final Office Action, dated May 31, 2012, U.S. Appl. No. 12/214,756, filed Jun. 20, 2008.
Non-Final Office, dated Feb. 12, 2014, U.S. Appl. No. 12/214,756, filed Jun. 20, 2008.
Final Office Action, dated Jul. 31, 2014, U.S. Appl. No. 12/214,756, filed Jun. 20, 2008.
Advisory Action, dated Oct. 9, 2014, U.S. Appl. No. 12/214,756, filed Jun. 20, 2008.
Advisory Action, dated Nov. 5, 2014, U.S. Appl. No. 12/214,756, filed Jun. 20, 2008.
Notice of Allowance, dated Sep. 10, 2015, U.S. Appl. No. 12/214,756, filed Jun. 20, 2008.
Non-Final Office Action, dated Dec. 27, 2011, U.S. Appl. No. 12/156,562, filed Jun. 2, 2008.
Final Office Action, dated Apr. 3, 2012, U.S. Appl. No. 12/156,562, filed Jun. 2, 2008.
Non-Final Office Action, dated Jul. 13, 2012, U.S. Appl. No. 12/156,562, filed Jun. 2, 2008.
Final Office Action, dated Jul. 31, 2013, U.S. Appl. No. 12/156,562, filed Jun. 2, 2008.
Non-Final Office Action, dated Mar. 26, 2015, U.S. Appl. No. 12/156,562, filed Jun. 2, 2008.
Final Office Action, dated Jul. 15, 2015, U.S. Appl. No. 12/156,562, filed Jun. 2, 2008.
Non-Final Office Action, dated Jul. 7, 2011, U.S. Appl. No. 12/006,587, filed Jan. 2, 2008.
Final Office Action, dated Jan. 18, 2012, U.S. Appl. No. 12/006,587, filed Jan. 2, 2008.
Advisory Action, dated Feb. 14, 2012, U.S. Appl. No. 12/006,587, filed Jan. 2, 2008.
Non-Final Office Action, dated Sep. 10, 2013, U.S. Appl. No. 12/006,587, filed Jan. 2, 2008.
Final Office Action, dated Jan. 31, 2014, U.S. Appl. No. 12/006,587, filed Jan. 2, 2008.
Advisory Action, dated Mar. 24, 2014, U.S. Appl. No. 12/006,587, filed Jan. 2, 2008.
Non-Final Office Action, dated Sep. 16, 2014, U.S. Appl. No. 12/006,587, filed Jan. 2, 2008.
Final Office Action, dated Jan. 23, 2015, U.S. Appl. No. 12/006,587, filed Jan. 2, 2008.
Advisory Action, dated Apr. 8, 2015, U.S. Appl. No. 12/006,587, filed Jan. 2, 2008.
Non-Final Office Action, dated Nov. 5, 2012, U.S. Appl. No. 12/072,381, filed Jun. 20, 2008.
Final Office Action, dated Apr. 5, 2013, U.S. Appl. No. 12/072,381, filed Feb. 25, 2008.
Non-Final Office Action, dated Sep. 29, 2011, U.S. Appl. No. 12/072,381, filed Feb. 25, 2008.
Final Office Action, dated Feb. 10, 2012, U.S. Appl. No. 12/072,381, filed Feb. 25, 2008.
Advisory Action, dated Apr. 16, 2012, U.S. Appl. No. 12/072,381, filed Feb. 25, 2008.
Advisory Action, dated May 16, 2013, U.S. Appl. No. 12/072,381, filed Feb. 25, 2008.
Notice of Allowance, dated Jun. 13, 2013, U.S. Appl. No. 12/072,381, filed Feb. 25, 2008.
Non-Final Office Action, dated Dec. 30, 2013, U.S. Appl. No. 14/034,457, filed Sep. 23, 2013.
Final Office Action, dated Jul. 1, 2014, U.S. Appl. No. 14/034,457, filed Sep. 23, 2013.
Advisory Action, dated Sep. 18, 2014, U.S. Appl. No. 14/034,457, filed Sep. 23, 2013.
Non-Final Office Action, dated Jan. 29, 2015, U.S. Appl. No. 14/034,457, filed Sep. 23, 2013.
Non-Final Office Action, dated Aug. 24, 2015, U.S. Appl. No. 14/034,457, filed Sep. 23, 2013.
Non-Final Office Action, dated Jan. 7, 2015, U.S. Appl. No. 14/318,630, filed Jun. 28, 2014.
Non-Final Office Action, dated Jul. 21, 2015, U.S. Appl. No. 14/318,630, filed Jun. 28, 2014.
Non-Final Office Action, dated Nov. 12, 2015, U.S. Appl. No. 14/283,132, filed May 20, 2014.
Non-Final Office Action, dated Nov. 13, 2015, U.S. Appl. No. 14/318,630, filed Jun. 28, 2014.
Non-Final Office Action, dated Dec. 31, 2015, U.S. Appl. No. 14/327,163, filed Jul. 9, 2014.
Non-Final Office Action, dated Feb. 2, 2016, U.S. Appl. No. 14/708,132, filed May 8, 2015.
Notice of Allowance, dated Mar. 25, 2016, U.S. Appl. No. 14/034,457, filed Sep. 23, 2013.
Non-Final Office Action, dated May 17, 2016, U.S. Appl. No. 12/156,562, filed Jun. 2, 2008.
Notice of Allowance, dated May 31, 2016, U.S. Appl. No. 14/318,630, filed Jun. 28, 2014.
Final Office Action, dated Jun. 9, 2016, U.S. Appl. No. 14/283,132, filed May 20, 2014.
Non-Final Office Action, dated Jul. 14, 2016, U.S. Appl. No. 15/169,615, filed May 31, 2016.
Notice of Allowance, dated Aug. 1, 2016, U.S. Appl. No. 14/708,132, filed May 8, 2015.
Non-Final Office Action, dated Aug. 9, 2016, U.S. Appl. No. 14/327,163, filed Jul. 9, 2014.
Non-Final Office Action, dated Sep. 9, 2016, U.S. Appl. No. 15/212,185, filed Jul. 15, 2016.
Notice of Allowance, dated Sep. 26, 2016, U.S. Appl. No. 15/212,185, filed Jul. 15, 2016.
Non-Final Office Action, dated Nov. 16, 2016, U.S. Appl. No. 12/156,562, filed Jun. 2, 2008.
Notice of Allowance, dated Dec. 15, 2016, U.S. Appl. No. 14/283,132, filed May 20, 2014.
Notice of Allowance, dated Jan. 18, 2017, U.S. Appl. No. 15/169,615, filed May 31, 2016.
Non-Final Office Action, dated Nov. 5, 2012, U.S. Appl. No. 12/214,756, filed Jun. 20, 2008.
Final Office Action, dated Feb. 23, 2017, U.S. Appl. No. 14/327,163, filed Jul. 9, 2014.
Notice of Allowance, dated Mar. 6, 2017, U.S. Appl. No. 15/292,043, filed Oct. 12, 2016.
International Search Report and Written Opinion dated Nov. 7, 2014 for App. No. PCT/US2014/044945, filed Jun. 30, 2014. 12 pages.
International Search Report and Written Opinion dated Jul. 27, 2015 for App. No. PCT/US2015/029109, filed May 4, 2015, 12 pages.
International Search Report and Written Opinion dated Nov. 2, 2015 for App. No. PCT/US2015/034054, filed Jun. 3, 2015, 15 pages.
Life Alert. "Life Alert's Four Layers of Protection, First Layer of Protection: Protection at Home." https://web.archive.org/web/20121127094247/http://www.lifealert.net/products/homeprotection.html. [retrieved Oct. 13, 2015], 4 pages.
International Search Report and Written Opinion dated Jun. 30, 2016 for App. No. PCT/US2016/030597, filed May 3, 2016, 12 pages.

(56) References Cited

OTHER PUBLICATIONS

"Office Action," Canadian Patent Application No. 2949211, dated Aug. 16, 2017, 4 pages.
"Office Action," Canadian Patent Application No. 2954351, dated Oct. 27, 2017, 3 pages.
International Search Report and "Written Opinion of the International Searching Authority," Patent Cooperation Treaty Application No. PCT/US2017/048284, dated Nov. 8, 2017, 8 pages.
Advisory Action, dated Jul. 3, 2017, U.S. Appl. No. 14/327,163, filed Jul. 9, 2014.
European Patent Application No. 14845956.3, "Extended European Search Report," dated Feb. 16, 2017, 8 pages.
"Extended European Search Report," European Patent Application No. 15796148.3, dated Jan. 8, 2018, 8 pages.
"Office Action," European Patent Application No. 14845956.3, dated Apr. 9, 2018, 4 pages.
"Extended European Search Report," European Patent Application No. 15818258.4, dated Feb. 26, 2018, 8 pages.
Non-Final Office Action, dated Sep. 7, 2017, U.S. Appl. No. 14/327,163, filed Jul. 9, 2014.
Final Office Action, dated Sep. 19, 2017, U.S. Appl. No. 14/879,329, filed Oct. 9, 2015.
Non-Final Office Action, dated Sep. 21, 2017, U.S. Appl. No. 12/156,562, filed Jun. 2, 2008.
Final Office Action, dated Oct. 3, 2017, U.S. Appl. No. 15/208,004, filed Jul. 12, 2016.
Vaidya, Govind, "Automatic Object Detection and Recognition via a Camera System", U.S. Appl. No. 16/163,521, filed Oct. 17, 2018, 40 pages.
"Partial Supplementary European Search Report," European Patent Application No. 16793194.8, dated Nov. 19, 2018, 10 pages.

* cited by examiner

SECURITY MONITORING AND CONTROL

CROSS-REFERENCE TO RELATED APPLICATIONS

This application is a continuation of U.S. patent application Ser. No. 14/283,132, filed May 20, 2014 and issued Apr. 25, 2017 as U.S. Pat. No. 9,633,547, which is hereby incorporated by reference in its entirety, including all references and appendices cited therein.

FIELD OF THE INVENTION

The present technology pertains to monitoring and control, and more specifically to security monitoring and control for a structure.

BACKGROUND OF THE INVENTION

Commercial and residential security systems detect intrusions and fire to prevent intruder and property damage. Present security systems suffer from false alarms and high monitoring costs. False alarms prevent first responders from being available to handle other in-progress or more urgent calls for service. In addition, first responders may levy fines for false alarms. Companies offer services to remotely monitor security systems. Some companies have trained staff to monitor their customers' security systems and call the appropriate authorities in the event an alarm signal is received. However, the cost and quality of these services vary by the provider, and can be beyond the reach of many families and organizations.

SUMMARY OF THE INVENTION

In one embodiment, the present technology is directed to a method for security monitoring and control. The method may include receiving sensor data from at least one first peripheral, the sensor data associated with at least one of activity inside and activity outside of a structure; determining a critical event based in part on the sensor data; creating an alert based in part on the critical event; getting user preferences associated with at least one of a user and a base unit; determining a response based in part on the alert and user preferences; and activating at least one of a second peripheral and a service based in part on the response.

In one embodiment, the present technology is directed to a base unit. The base unit may include: a processor; and a memory coupled to the processor, the memory storing instructions executable by the processor to perform a method for security monitoring and control including: receiving sensor data from at least one first peripheral, the sensor data associated with at least one of activity inside and activity outside of a structure; determining a critical event based in part on the sensor data; creating an alert based in part on the critical event; getting user preferences associated with at least one of a user and a base unit; determining a response based in part on the alert and user preferences; and activating at least one of a second peripheral and a service based in part on the response.

In one embodiment, the present technology is directed to a non-transitory computer-readable storage medium having embodied thereon a program, the program being executable by a processor to perform a method for security monitoring and control. The method may include receiving sensor data from at least one first peripheral, the sensor data associated with at least one of activity inside and activity outside of a structure; determining a critical event based in part on the sensor data; creating an alert based in part on the critical event; getting user preferences associated with at least one of a user and a base unit; determining a response based in part on the alert and user preferences; and activating at least one of a second peripheral and a service based in part on the response.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments. The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Figure 1:
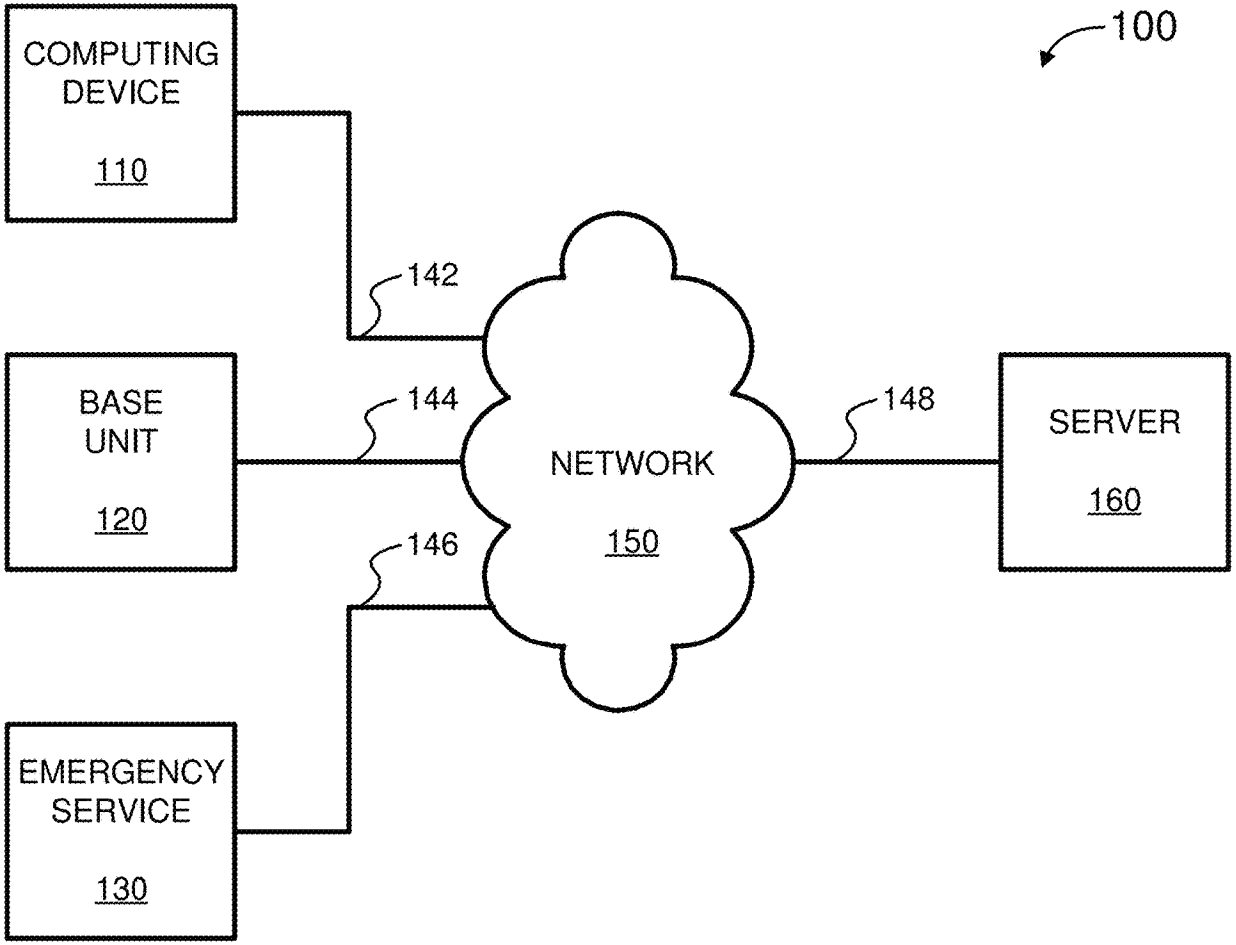
FIG. 1 is a simplified block diagram of a system for security monitoring and control, according to some embodiments of the present invention.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a", "an," and the are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

According to various embodiments of the present invention, a base unit communicatively coupled to the Internet communicates with peripherals in and/or near a structure, for example, using wired and/or wireless communications. The peripherals may detect/sense conditions such as motion, glass breakage, smoke, heat, flooding, and the like. The peripherals may communicate the detected/sensed conditions to the base unit over any of several wired and/or wireless communications and/or networking mechanisms. The base unit may communicate the detected/sensed conditions over the Internet to a server. The base unit may also communicate with a web client (or other client or software application) on a computing device (e.g., PC, tablet computer, smart phone, etc.).

A user operating the computing device may monitor and respond to detected/sensed conditions in and/or near the structure. Additionally or alternatively, the base unit may communicate with the computing device. In some embodiments, the base unit may, automatically and/or in response to at least one of instructions from a user and/or inputs from peripherals, control a peripheral and/or service. By way of example, the base unit may perform at least one of activate an internal or external siren, control lighting (e.g., flash, turn on, and turn off), activate audible and/or visual alarm in a smoke detector, launch a personal surveillance drone, lock and/or unlock door, move window coverings (e.g., open, close, and trim), post on social media, and the like.

FIG. 1 illustrates a system for security monitoring and control (system) 100, according to some embodiments. The system 100 includes computing device 110, base unit 120, emergency service 130, communications 142-148, network 150, and server 160.

Computing device 110 include at least one of a personal computer (PC), hand held computing system, telephone, mobile computing system, workstation, tablet, phablet, wearable, mobile phone, server, minicomputer, mainframe computer, or any other computing system. Computing device 110 is described further in relation to computing system 1300 in FIG. 13.

In some embodiments, computing device 110 may include a web browser (or similar software application) for communicating with base unit 120 and/or server 160. For example, computing device 110 is a PC running a web browser inside (or outside) a commercial or residential structure. Additionally or alternatively, computing device 110 is a smart phone running a client (or other software application).

In various embodiments, computing device 110 is used for telecommunications. For example, the user from his web or smartphone client upon determining that the intruder alert is valid, could initiate a 911 call as if it were originating from the structure, rather than from the user's smartphone client. Normally a 911 call from a cell phone is directed to a public safety access point (PSAP) associated with the geographical location of the cell phone. For a user at a remote location who is alerted that his house is being invaded, dialing 911 from his cell phone could normally result in significant delay as he explains the situation to the PSAP serving the physical location of his smartphone (rather than that of the house that has been invaded), then waits for his call to be transferred to a PSAP in the area of his home and then takes the time to communicate the location of the house that is being invaded (which may even be in another state), and convinces the authorities to go to the invaded house.

In contrast, since base unit 120 may also provide VoIP service for the home, base unit 120 may already be provisioned to have its phone number associated with the appropriate physical address of the house, according to some embodiments. For example, the user operating his web or smartphone-based client, may initiate a 911 call as if it were originating from the invaded house. The call is directly connect to the PSAP that is local to the invaded house, with the proper address electronically passed to the PSAP as if the call had originated from the invaded house, bypassing the delays inherent in the prior art. Such 911 calls, from a location remote from the structure and/or "spoofing" the address presented to the PSAP (e.g., by provisioning the structure's address to the 911 service provider), may be used for other alert situations in the structure (e.g., smoke detector triggers, swimming pool monitor triggers, etc.).

In various embodiments, computing device 110 presents information, received from base unit 120 and/or server 160, graphically and/or textually, to at least one user (not shown in FIG. 1). The user may, for example, set up preferences, review sensor information (e.g., alarms) in real time, control peripherals, review logs, and the like using a web browser, client, or other software application.

Base unit 120 are disposed within or near to a commercial or residential structure (e.g., office building, house, townhouse, condominium, apartment, recreational vehicle, aircraft, yacht, and the like; not shown in FIG. 1) to be monitored and controlled. Base unit 120 controls and/or receives data from peripherals (not shown in FIG. 1) disposed in and about the commercial or residential structure. The peripherals are described further in relation to FIG. 2.

Emergency service 130 includes one or more of private security (e.g., security guard), law enforcement (e.g., police, sheriff, etc.), fire (e.g., fire and rescue service), emergency medical service (e.g., ambulance), and the like. In some embodiments, communication with emergency service 130 is through a public-safety answering point (PSAP), sometimes called "public-safety access point." A PSAP is a call center responsible for answering calls to an emergency telephone number for police, firefighting, ambulance services, etc. Telephone operators at the PSAP may be responsible for dispatching emergency service 130.

Communications 142-148 are wired and/or wireless communications (and combinations thereof) which communicatively couple computing device 110, base unit 120, and server 160 to each other and to network 150. For example, communications 142-148 may be at least one of plain old telephone service (POTS), cellular/mobile network (e.g., 1G, 2G, 3G, and 4G), and other voice communications network, dial up, digital subscriber line (DSL), cable Internet, power-line Internet, WiFi (e.g., IEEE 802.11), Bluetooth, Bluetooth low energy (BLE), WiMAX (e.g., IEEE 802.16), satellite broadband, mobile broadband (e.g., 2G, 3G, and 4G), and other broadband access. Although a single line is used to depict communications 142-148, there may be multiple computing devices 110, base units 120, emergency services 130, and servers 160, each of which may use different combinations of the wired and/or wireless communications described above.

Network 150 is a system of interconnected computer networks, such as the Internet. Additionally or alternatively, network 150 may be a private network, such as home, office, and enterprise local area networks (LANs).

Server 160 includes one or more systems (e.g., software and computer hardware) that respond to requests across network 150 to provide, or help to provide, a network service. Services, for example, include at least one of Voice over Internet Protocol (VoIP), Enhanced 911 (E911), Short Message Service (SMS), email, social media posting (e.g., Nextdoor, Facebook, Twitter, YouTube, Instagram, etc.), user preferences, notifications/alarms, and the like. In some embodiments, at least one service/function of server 160 may be performed alternatively by or in combination with base unit 120. Server 160 may be disposed in, near, or far away from the structure. Server 160 is described further in relation to computing system 1300 in FIG. 13.

In some embodiments, alerts for help in the event of an intruder, detection of an unauthorized pool entrance, fire, flood, or other emergency situation take new forms. Prior to the present technology, a user dialing 911 was the most effective response to an emergency. In contrast, in various embodiments the user via a web or smartphone-based client on computing device 110 may select from many more options for responding to an emergency quickly and conveniently. For example, with the selection of a button in a graphical user interface of the smartphone client, the web or smartphone client on computing device 110 can originate a 911 call through server 160, as if it came from the home location. By way of further example, a pre-programmed tweet can be posted to the user's account on Twitter and/or to a Nextdoor neighborhood group (e.g. "something's happening at my home (<address>), if you are nearby, please check it out"). By way of additional example, an automated message could be posted on the user's Facebook wall or a Facebook wall shared by a neighborhood watch group. In an emergency situation, quickly establishing broad awareness can be essential to successful resolution of the situation. Social networks make possible such broad notifications to crowd-source home monitoring without the expense of professional monitoring services and/or to augment the professional monitoring services.

In various embodiments, when base unit 120 (and associated resources and services) are activated, the user may be given the option to be automatically added as a friend for a neighborhood watch Facebook page, join a Nextdoor neighborhood group, be added as a follower on a Twitter feed customized for her physical address, and the like. Such pages, posts, and feeds may be automatically accessible through the web or smartphone-based client on computing device 110 for posting in the event of an emergency, and advantageously provide neighbors and/or the community around a structure with awareness of emergency events taking place nearby, with a high degree of automation.

Moreover, social networking along with coordination of the services and devices described herein make possible new capabilities for bonding communities together to enhance their collective security. In some embodiments, when an intruder is detected based at least on his Bluetooth or cellular MAC address (as described below), the MAC address(s) may be communicated to other base units 120 on network 150, so that the movements of the intruder can be tracked. In various embodiments, when an intruder is detected in one house, all the other houses in the neighborhood who subscribe to the same service can be placed on a heightened state of readiness (e.g., lock down). For example, surveillance cameras on the house neighboring the house under attack are activated with the video being recorded. By way of further example, exterior lights under control of systems in other houses that subscribe to the same system are automatically turned on. By way of additional example, nearby homes are instructed to log any unusual Bluetooth "fingerprints," in case the intruder parked a vehicle a few doors down, but in range of another subscriber's home. When the occupant of a house that is being invaded receives a notification on his smartphone, for example, a software application on computing device 110 communicates that there has been suspicious activity in another house in the neighborhood, thus increasing the probability that the occupant will not dismiss the alert as a false alarm. If an intrusion is detected in one home in the neighborhood, for example, then rather than just launching his own drone, all the surveillance drones in the neighborhood launch to try to identify the intruder, or begin performing a patrol circuit of their "home" building, both for video surveillance and deterrence. Given the expense of UAVs, a neighborhood as a whole may pool its resources, so that a single UAV serves an entire block, cul-de-sac, and other grouping of residents.

Figure 2:
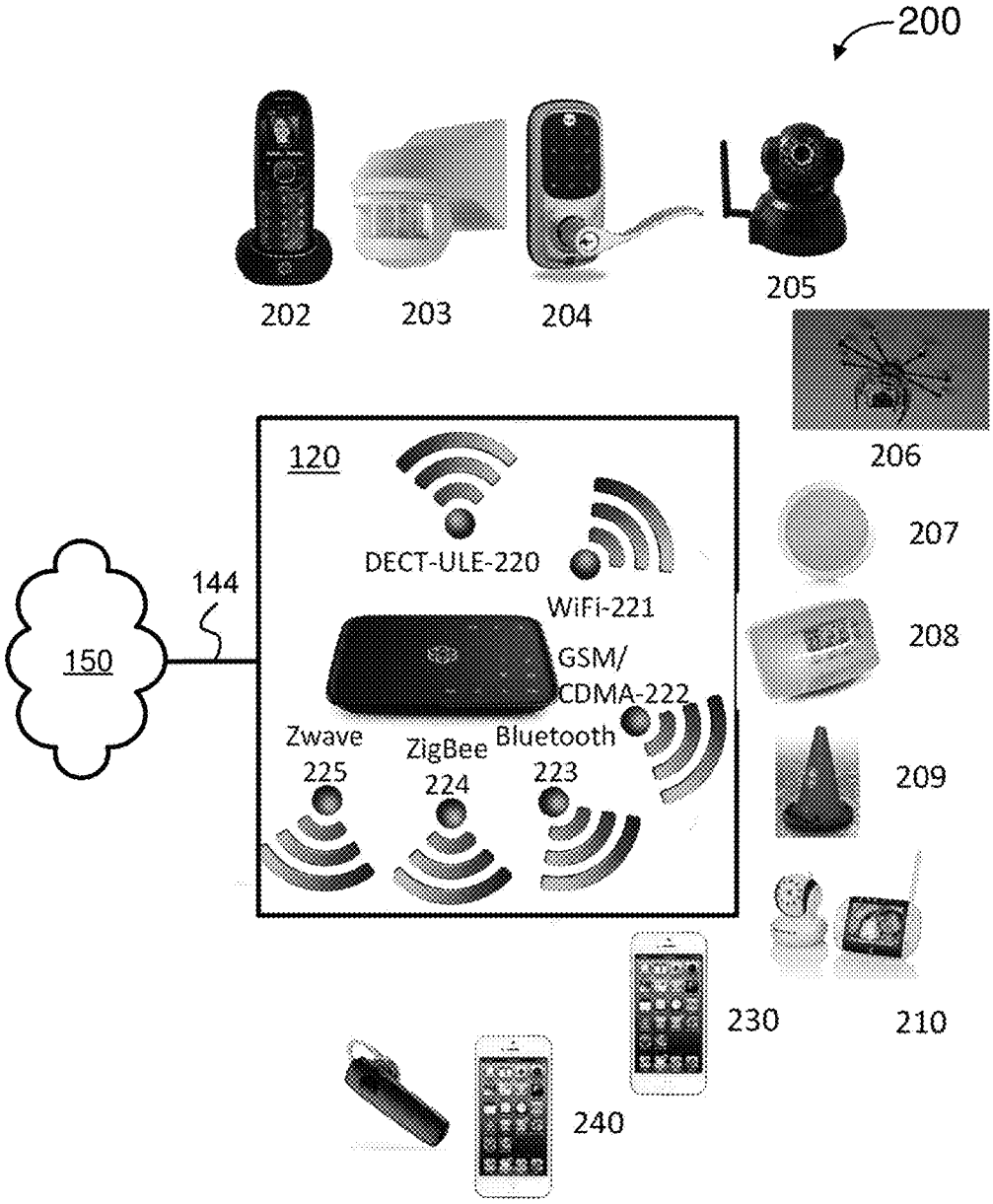
FIG. 2 is a simplified diagram of an environment of a structure, according to some embodiments.

FIG. 2 illustrates an environment of a structure (environment) 200 according to some embodiments. Disposed in environment 200 is at least one of base unit 120, peripherals 202-210, and optionally smart phone 230 authorized by the system owner and potentially connected or paired with the base unit, and also optionally, additional non-owner (unpaired) devices 240.

Base unit 120 is communicatively coupled to network 150 using communications 144. Base unit 120 includes at least one network interface for wired and/or wireless communications. In some embodiments, base unit 120 includes at least one of an Ethernet adapter, cable modem, digital subscriber line (DSL) modem, wireless modem, cellular data connection, and the like (not shown in FIG. 2), for communication with network 150 over communications 144.

Base unit 120, may also include numerous network interfaces and/or modems/radios 220-225 (internal or externally coupled) to communicatively couple devices in environment 200. These may include, but are not limited to interfaces for DECT 220, WiFi 221, GSM/CDMA 222, Bluetooth 223, ZigBee 224 and ZWave 225.

By way of example, base unit 120 may include a DECT modem/radio 220 which may communicate with a DECT device, including handset 202. Integration of the DECT modem in base unit 120 offers the advantage of higher quality audio, because integration eliminates loss of audio fidelity associated with passing audio through a band-limited Foreign Exchange Station (FXS) port to a separate DECT base device. Integration also offers the benefit of having fewer devices to manage, and allows interaction with DECT devices for other purposes, as detailed below.

By way of further example, base unit 120 includes Bluetooth modem 223. Bluetooth modem 223 may be paired with and communicate with devices such as a Bluetooth equipped smartphone 230 operated by the system user. In some embodiments, (telephone) calls may be directed from the smart phone so as to ring the smart phone and/or at least one DECT phone 202 in or near the structure. In some embodiments, DECT phone 202 is associated with a telephone service provisioned to a home or business. Base unit 120 is described further in relation to base unit 120 in FIG. 3 and computing system 1300 in FIG. 13.

In various embodiments, smart phone 230 and base unit 120 are Bluetooth paired. Incoming calls for smart phone 230 may be directed to base unit 120 and provided to the FXS port and/or DECT phone 202. Directing smart phone 230 calls in this way has the advantage of a more comfortable telephone experience, because DECT phone 202 may have superior ergonomics relative to smart phone 230. Additionally, incoming POTS and/or VOIP telephone calls may be directed from base unit 120 via Bluetooth to smart phone 230.

As another example of base unit 120 including various network interfaces, it may include microcell 222 (e.g., for CDMA, LTE, GSM, etc.) to provide (short-range) mobile/cellular service in and near the structure. Microcell 222 offers the advantage of improving reception of mobile/cellular signals, for example, when the structure is in an area where mobile/cellular coverage is marginal. Microcell 222 also offers the benefit of bypassing local mobile/cellular service and using the base unit 120 connection 144 to network 150 to backhaul calls originating from or terminating at smart phone 230. In this way, base unit may provide higher quality communications to smart phone 230.

As another example of base unit 120 including various interfaces, it may include a WiFi modem/radio 221 (e.g., IEEE 802.11). In addition, the structure may have a WiFi network which is accessible or delivered by base unit 120, and which may be used to communicate with at least one of peripherals 202-210.

In some embodiments, the various network interfaces (radios/modems) 220-225 may also serve as "sensors." For example, in the case of Bluetooth, communication between base unit 120 and an unpaired Bluetooth-enabled device (including a phone or headset) 240 is possible. Many people (including intruders and other persons with nefarious objectives) have Bluetooth-enabled cell phones and/or Bluetooth peripherals and many people leave their cell phone Bluetooth radios turned on and in discoverable mode (all the time). For example, such people may typically leave their Bluetooth-enabled smart phones in discoverable mode, so that when they enter their car, their phones can automatically establish communication with the car's audio system. Though data sharing with the car audio system requires a personal identification number and going through the pairing process, any cell phone with its Bluetooth turned on may be broadcasting information for which other Bluetooth devices can listen. In this way, Bluetooth-enabled cell phones may provide an "electronic fingerprint." Similarly, other Bluetooth-enabled devices (e.g., headset, smart watch, fitness device, audio system of a car parked nearby, and other computing devices (e.g., tablet computer, phablet, notebook computer, etc.) in the car parked nearby), may also provide an "electronic fingerprint."

In response to inputs from peripherals 202-210, base unit 120 may detect and record an electronic fingerprint associated with one or more unpaired Bluetooth-enabled devices 240 within its range. In this way, base unit 120 may record information (in one embodiment, a MAC address of one or more of an intruder's unpaired Bluetooth-enabled device 240.) By logging such MAC addresses, the base unit 120 may help identify an intruder's unpaired Bluetooth-enabled device 240, for example, at the time of a break in. By further example, base unit 120 may be configured to record the fingerprint of any unknown device or any device seen at an unexpected time, or even to respond in a programmatic way as discussed below. (see also FIGS. 10, 11 and 12)

By logging electronic fingerprint(s) such MAC addresses, the base unit 120 may help identify an intruder's unpaired Bluetooth-enabled device 240, for example, at the time of a break in. To aid an investigation, authorities such as law enforcement may determine information such as a manufacturer of unpaired Bluetooth-enabled device 240 based on the detected electronic fingerprint(s). After the intruder is apprehended, authorities may "match" the detected electronic fingerprint (and determined information) to unpaired Bluetooth-enabled device 240 in the suspect's possession. Additionally or alternatively, authorities can identify the specific owner of the unpaired Bluetooth-enabled device 240 based on the associated electronic fingerprint by contacting the cellular provider, manufacturer, etc. The utility of this technique may depend on at least the settings of unpaired Bluetooth-enabled device 240 (selected by the intruder), the manufacturer of the cell phone, and the provider of the Bluetooth software.

In addition, unpaired Bluetooth-enabled device 240 in discoverable mode may be vulnerable to a variety of exploits that can extract information such as a media access control (MAC) address. In some embodiments, base unit 120 may run software, send a chunk of data, send a sequence of commands, and the like that takes advantage of a bug, glitch, or vulnerability in order to gain control of unpaired Bluetooth-enabled device 240.

By way of further example, the Bluetooth modem 223 is configured such that base unit 120 may gather a range of data about the intruder's unpaired Bluetooth-enabled device 240 (referred to as "Bluesnarfing"), and/or take control of the intruder's unpaired Bluetooth-enabled device 240 (referred to as "Bluebugging"). For example, a user using a web or client on computing device 110 is given the option to have the base collect the MAC address of the intruder's cell phone and/or attempt to take control of the intruder's unpaired Bluetooth-enabled device 240, to perform at least one of determining its phone number, downloading the intruder's address book and/or other identifying information. Base unit 120 may (surreptitiously) place a 911 call from the intruder's unpaired Bluetooth-enabled device 240, resulting in the intruder's unpaired Bluetooth-enabled device 240 leading authorities directly to him, even after he leaves the structure.

Similarly, Microcell 222 may also identify cell phones within range to obtain "electronic fingerprints" from device 240, for example, at the time of an intrusion into the structure. Microcell 222 may typically provide greater range and more certain connection with the intruder's cell phone than Bluetooth. Similar to Bluetooth, Microcell 222 may determine identifying information from the intruder's cell phone, without creating a permanent or authorized connection.

Similarly, WiFi radio 221 may be used to obtain "fingerprints" from device 250, for example at the time of an intrusion into the structure. WiFi radio 221 may determine a MAC addresses associated with a computing device carried by the intruder (that comes within range of WiFi radio 221).

Further, in some embodiments, base unit 120 may log all MAC addresses it encounters from any source using any wireless protocol to which it has access using any of the internal network interfaces or modems 220-225.

In various embodiments, a database is maintained by the Bluesnarfing process (or alternately by cellular, WiFi, or other protocol device monitoring processes) recording a date, time, MAC address, device name, manufacturer, model, etc. Event records may include an arrival time, departure time, and other (passively) collected activity information. One or more of device 240 detected using such mechanisms may have additional data associated with them by a user. For example, additional data may include one or more of a name, group, and notes. Groups, for example, include family, friend, nanny, babysitter, house sitter, housekeeper, gardener, repair person, and the like.

The above database may be monitored. For example, events are generated based at least on default rules and/or rules configured by the user. The events may also be recorded in the database and may be used to trigger notifications. Notifications, for example, are at least one of an email, SMS text message, automated telephone call, and the like. Non-limiting examples of events which trigger a notification include: when a particular device appears (e.g., child home from school); when a device disappears (e.g., child leaves for school, teenager sneaks out of the house, etc.); when a device appears and disappears (e.g., monitor the arrival, departure, and/or length of stay of the housekeeper); and when a previously unknown device appears; when a non-family group device appears/disappears between 9 PM and 5 AM (e.g., teenager entertains guests after curfew).

As would be readily appreciated by one of ordinary skill in the art, the database and notification processes described herein can be performed by base unit 120 and/or on server 160. For example, to prevent loss of information in the event that base unit 120 is removed from the structure, base unit 120 may provide a log to server 160 periodically, as well as anytime a potentially triggering event occurs (e.g., a glass break sensor or any of the other peripherals 202-210 triggering an event).

Base unit 120 is also communicatively coupled to at least one of peripherals 202-210 using at least one of wired and wireless communications interfaces 220-225. By way of example and not limitation, wireless communications may be one or more of Digital Enhanced Cordless Telecommunications Ultra Low Energy (DECT ULE) 220 (e.g., according to the European Telecommunications Standards Institute (ETSI)), WiFi 221 (e.g., IEEE 802.11), cellular/mobile network 222 (e.g., GSM, CDMA, etc.), Bluetooth and/or BLE 223 (e.g., according to the Bluetooth Special Interest Group), ZigBee 224 (e.g., IEEE 802.15), and ZWave (e.g., according to the Z-Wave Alliance), and the like.

As shown in FIG. 2, base unit 120 may have various combinations of wireless interfaces (e.g., based on a diversity of interfaces of various devices found in the structure). DECT ULE 220 provides excellent range, operation in a licensed band, and good energy efficiency for long battery life, but unlike Bluetooth, CDMA, LTE, and GSM, DECT ULE may not typically found in cell phones and may have lower bandwidth than WiFi. ZWave 225 is widely adopted in a range of devices. ZigBee 224 is widely used in utility meters. As would be readily appreciated by one of ordinary skill in the art, specific wireless communications (e.g. DECT ULE)—described in relation to various embodiments—may be other wireless communications (e.g., WiFi, Bluetooth, Bluetooth LE, ZWave, ZigBee, etc.). In addition, different protocols may be used, each having associated performance characteristics. Some embodiments include base unit 120 which supports all of the standards suggested by FIG. 2. Some cost effective embodiments include various subsets of all of the standards suggested by FIG. 2. For example, base unit 120 includes DECT ULE (or WiFi) as a backbone network to connect to devices that route to at least one (short-range) standard (e.g., ZWave, ZigBee and Bluetooth). By way of further example, base unit 120 includes a DECT ULE modem and communicates with a plug-in ZWave adapter disposed on or near a front door, to take advantage of the wide range of ZWave-enabled door locks.

ZWave includes a single "Primary Controller" and optionally additional "Secondary Controllers." ZWave may also have any number of slave devices. The Primary Controller includes and/or excludes slave nodes from the network, so it is a node having (guaranteed to have) a complete ZWave routing table. In some embodiments, a DECT ULE to ZWave bridge may be used to bridge DECT ULE to a ZWave Primary Controller, since the ZWave Primary Controller preferably accesses all the slave devices. This may imply ZWave devices are added to the DECT ULE network piecemeal, rather than allowing DECT ULE to tap into an existing network. As devices are included in a ZWave segment of the network, the bridge develops a routing table (e.g., according to the ZWave specification). Changes to the routing table, (e.g., from addition and/or removal of ZWave nodes) is reflected back to the main DECT ULE controller, so that it may too have a complete topology for that segment and can integrate the complete topology into the overall topology of the combined DECT ULE and ZWave network in the structure.

In some embodiments, the DECT ULE to ZWave bridge may be configured in at least two different ways, depending at least on whether the system has knowledge of the ZWave controller node in the DECT ULE bridge or not. For example, if the system (or its software or APIs) knows that the ZWave controller exists and is tightly coupled to the DECT ULE to ZWave bridge, then the ZWave messages may be encapsulated. In other words, a command (or command string) that would traditionally have been presented to the ZWave controller via a direct interface (e.g., serial, Universal Serial Bus (USB), I2C, SPI, etc.) may be encapsulated in a datagram, and set to the DECT ULE to ZWave bridge with an indication (e.g., in the datagram or in the transfer mechanism) of the encapsulation. The bridge may then act in a "dumb" manner, and presents the command directly to the ZWave controller (e.g., via Serial, USB, I2C, SPI, or other connection).

For example, if the system or software is not aware of (or wishes to disregard) the bridging functionality, then the DECT ULE to ZWave bridge may handle all of the translation. The DECT ULE to ZWave bridge may issue commands to the ZWave controller to retrieve at least one of the ZWave network topology, the list of nodes/devices, and the capability of each node/device. The DECT ULE to ZWave bridge may create "pseudo-devices" within itself, and notify the ULE master to update its directory. When an entity in the system wishes to communicate with a device on the ZWave bus, the bridge may take the commands from the entity, transcode from standard DECT ULE forms/APIs into standard ZWave forms/APIs, and issue the appropriate commands to the ZWave controller.

The DECT ULE to ZWave bridge may handle routing translation between busses. The DECT-ULE controller treats the ZWave segment nodes as multiple endpoints within the DECT-ULE->ZWave bridge node. Similarly, any secondary controller may treat DECT ULE nodes for which it has been made aware as additional functional units within the bridge device.

ZWave messages may not necessarily be transmitted directly to a destination node, but instead may pass through up to four routing nodes. ZWave nodes may not receive a message while sleeping (e.g., to conserve battery power), delivery time may be unbounded. The DECT ULE to ZWave bridge may run (essentially) asynchronously, with (only) an immediate response to a message request being an indication of the destination's validity. Subsequently, at least one of an ACK/NACK and a TimeOut may be returned to the DECT ULE controller, depending on the ZWave device's capabilities.

ZigBee may be said to resemble ZWave in that it is also a mesh network which may need a DECT ULE to ZigBee bridge to act as a primary controller for the ZigBee network of devices.

An potential issue with bridging to Bluetooth Low Energy (BLE) is encapsulating Generic Attribute Profile (GATT) attribute fragments into Internet Protocol (IP) packets and transferring them back to the DECT ULE master. The DECT ULE master may un-encapsulates the GATT attribute fragments from the Internet Protocol (IP) packets, and may pass each of the GATT attribute fragments to the engine as an event. The DECT ULE-BLE bridge may track a segment topology and all of the paired nodes. The segment topology and all of the paired nodes may be presented as sub functions of the DECT ULE-BLE bridge. The DECT ULE-BLE bridge may optionally provide a generic BLE-gateway to the Internet via encapsulation.

As would be readily appreciated by one of ordinary skill in the art, base unit 120 providing such bridging capabilities is not limited to the protocols described in the example above, but could be any pair of protocols either directly supported by the base unit 120 or by an external device connected to base unit 120 (not shown in FIG. 2), including as a way to bridge existing systems with protocols not yet defined by way of additional peripherals connected to 120 to provide additional network connections and using the capabilities of 120 to provide translation.

Wired and wireless communications as described herein may be used to efficiently monitor and control devices. For example, base unit 120 may use an ULE channel to monitor and control thousands of sensor and/or actuators 203-210 (in addition to audio devices such as DECT phone 202).

DECT phone 202 may be a portable unit, such as a cordless telephone and optionally a base unit (e.g., to charge the portable unit). DECT phone 202 may originate and receive telephone calls, for example, using POTS, VOIP, and the like.

In some embodiments, DECT phone 202 also performs monitoring and/or control functions. In typical operation, an incoming call may cause DECT phone 202 to ring. A microphone and speaker of DECT phone 202 may be activated in response to a user pressing a button (or similar input), indicating that he wishes to answer the incoming call. In various embodiments, when a (remote) user has been notified that there may be an intruder in the home, the operation of DECT phone 202 is modified. With the appropriate firmware, for example, DECT phone 202 can be directed by the base unit 120 to silently connect to base unit 120 and activate its microphone (leaving the speaker muted). For example, a handset sitting on a table or otherwise innocuously disposed within the structure "listens in" on what is going on in the room, without ringing or providing any other indication that it is active. By way of further example, any or all of the handsets in the home are activated in this manner, such that multiple locations in the structure are simultaneously monitored for any audible activity.

In some embodiments, when an intruder has entered the home, the user's web or smartphone-based client on computing device 110 (FIG. 1) is notified of the intrusion and the user can choose to signal the base to activate some or all of the handsets in the home to silently "listen in" on activity in the home. By monitoring the structure in this way, the user may determine if the intruder alert is valid or a false alarm. From his smartphone, the user may choose to listen in to handsets one by one, or he may choose to listen to a mix (performed by the base or server infrastructure) of all of the handsets at once. The base or server infrastructure or client may record any or all of the audio streams coming from the activated handset(s), or other connected devices in the home such as a video door camera, for example, to provide evidence for use in an investigation and/or against the intruder during legal proceedings such as a trial.

In some embodiments, DECT phone 202 is used to communicate with the intruder. For example, after evaluating the state of the sensors in the home and perhaps listening in to the activity of the intruder through the silently activated DECT handsets, the user can engage the intruder directly. In various embodiments of the invention, the user may use his web or smartphone client on computing device 110 to direct one or more of DECT phone 202 to enter intercom mode which engages the speaker and microphone of any or all of the DECT phone 202 in the structure to tell the intruder to "Stop what you are doing. Leave the house!" This type of direct engagement may be more effective than calling the police or neighbor to investigate.

Some embodiments of the present invention include special/custom firmware in DECT phone 202 (e.g., in base and/or handset) to enable DECT phone 202 to activate silently, enter listen in mode, and change to intercom mode under the control of the remote client. As would be readily appreciated by one of ordinary skill in the art, the operation described herein does not correspond to standard DECT behaviors. In fact, present DECT handsets are activated individually. In contrast, a network of DECT handsets, ideally with speakerphones, can all connect to the base simultaneously and, engaging their speakerphones, blare out a warning to the intruder to scare him off, according to some embodiments. For example, the warning is pre-recorded and streamed from server 160. In some embodiments, there is more than one message and each message is used in response to one or more specific sensed events. For example, in response to an intruder being detected in the living room or smoke being detected in the kitchen, "Motion in living room!" or "Smoke in the kitchen!" is respectively announced from all the handsets in the structure.

By way of further example, when a handset is in this monitoring announcement mode and its firmware senses the handset is removed from the cradle or activated, the announcement stops to allow a user to attempt to place a phone call (e.g., to 911). In some embodiments, the software application on computing device 110 (e.g., smartphone client, web client, etc.) is based on a Session Initiation Protocol (SIP) (e.g., according to Internet Engineering Task Force (IETF) RFC 3261) platform. PJ SIP, for example, includes a signaling protocol (SIP), a multimedia framework, and NAT traversal functionality into a high-level multimedia communication application programming interface (API). In some embodiments, the SIP platform is directed by the software application to initiate a VoIP session using server 160. Server 160 may direct base unit 120 to open the intercom channel to DECT phones 202 and the call is completed at any or all of DECT phone 202 operating in intercom mode (e.g., no action by the intruder is required for the call to be connected).

Sensor 203 may include at least one of a motion sensor, door/window sensor, glass breakage sensor, flood sensor, smoke detector, heat sensor, carbon monoxide sensor, and the like.

Smoke and/or carbon monoxide alarm sensors 203 senses the atmosphere and sounds a siren when smoke and/or carbon monoxide (respectively) are detected. In some embodiments, these alarms are connected to the base through DECT ULE (or other wireless communication). Such network connectivity enables several new modes of operation for these alarms. For example, the function of the siren in the detector may be separately triggered (e.g., under firmware control) using DECT ULE signals, which has the advantage of better coordination between multiple detectors in the structure. In response to detecting smoke in one room or zone, rather than just a particular smoke detector sounding its siren, the particular smoke detector communicates the triggering event to base unit 120. Base unit 120, after optionally communicating with server 160 to determine any user preferences, may trigger some or all of the smoke and/or carbon monoxide detectors in the structure. A fire in the kitchen downstairs, for example, immediately results in the siren sounding in the bedroom area upstairs.

In some embodiments, at least some functions of the smoke or carbon monoxide alarm (e.g., testing the smoke alarm, disabling a false alarm, etc.) may be controlled by computing device 110 (e.g., smart phone 230). In various embodiments, when an intruder's penetration of the structure is detected by peripherals 202-210 and a (remote) user monitors the situation from his smartphone, the remote user activates the blaring siren of all the detectors to sound throughout the structure, absent any fire. Configuration and operation of the alarms in this manner offers the benefit of reinforcing the sound of a separate siren or the opportunity to eliminate the cost associated with a separate siren device, which would otherwise be required to affect such an audible intruder alarm.

Active device 204 includes at least one of an electrical switch, siren, speaker, locking mechanism (e.g., door handle lock, dead bolt lock, electromagnetic lock, etc.), light fixture, and the like. These active devices can be controlled by base unit 120 to programmatically respond to input from the user (via computing device 110), from various sensors 202, or other events as discussed.

Camera 205 may be one or more of a video camera and still image camera. For example, camera 205 maybe a closed-circuit television (CCTV) camera. By way of further example, camera 205 may be an Internet protocol camera (IP camera). Camera 205 may be disposed at any of a variety of locations inside and/or outside the structure (e.g., for viewing persons arriving at a front door). One or more of camera 205 may be independently controlled (e.g., by a user through computing device 110), activated when UAV 206 (see below) follows an intruder into an area covered by one of camera 205, when a sensor 203 detects activity near one of camera 205, etc.

Hazard sensor 209 is used to prevent injury or death in hazards associated with the structure. For example, many pools, hot tubs, and other hazards are fitted with sensors that generate an alert in the event a child or pet falls into (or otherwise obtains access to) the pool, hot tub, and other hazard. Hazard sensor 209 may include at least one of gate sensor (e.g., detects when a gate providing access to the hazard is opened), motion sensor in the pool area, and sensor which detects disruption to the water surface.

Unmanned aerial vehicle (UAV) 206 may be a quadcopter or other drone. UAV 206 may include an electronic control system and electronic sensors to stabilize the aircraft. UAV 206 may also include one or more sensors, such as a video camera. UAV 206 may be operated inside and/or outside the structure. In some embodiments, UAV 206 is a terrestrial and/or aquatic vehicle, such as an unmanned ground vehicle (UGV), autonomous surface vehicles (ASV), autonomous underwater vehicle (AUV), and the like.

For example, when hazard sensor 209 detects an unsafe condition (for example the surface of a pool or hot tub being disturbed, perhaps by a child entering) or a sensor 203 detects a security situation (motion sensor activated, glass break sensor activated), a (remote) user monitoring the situation in the structure using computing device 110 may instruct UAV 206 to launch and follow a pre-programmed flight path to video the outside of the structure (e.g., a pool area) or location of the security situation. UAV 206 may maintain a connection to base unit 120 through the WiFi network for its entire flight path and provide live video of the exterior of the structure to base unit 120. Base unit 120 may stream the live video to computing device 110 (e.g., smart phone 230). The user may also modify the flight path in response to the (observed) situation, communicating the flight path changes from computing device 110, though network 150, to base unit 120. Base unit 120 may control UAV 206 through the structure's WiFi network.

In some embodiments UAV 206 may be programmed to (follow waypoints on a path to a certain location and) hover near a certain location (e.g., a front door to awaiting the intruder's exit, a pool to verify a child has fallen in, etc.). In various embodiments, UAV 206 may take video of license plates of nearby cars in case one of them belongs to the intruder, while flying down a street (e.g., under real-time control from the user using computing device 110, following a pre-programmed route, etc.). In various embodiments, when UAV 206 flies out of range of the WiFi network, the video may be stored locally in UAV 206. In response to UAV 206 again being within range of the WiFi network (e.g., on its way back to its landing pad), the video may be uploaded through the WiFi network. In this way, UAV 206 may advantageously convince a would-be intruder—upon seeing UAV 206 circling the structure at the slightest provocation—to try a softer target.

In various embodiments, UAV 206 is employed in additional or alternative ways. UAV 206 may perform periodic patrols (e.g., following programmed routes around the property on which the structure is disposed). UAV 206 may include sensors (e.g., motion sensor, infrared cameras, additional Bluetooth sensors, etc.) for monitoring (e.g., to detect an unfamiliar car, a pedestrian, and the like within the property's perimeter). UAV 206 may communicate through WiFi with base unit 120 (e.g., to initiate a notification of the user via computing device 110). The user can then monitor the situation and direct further action. UAV 206 may also launch to perform a pre-programmed mission in response to input received from at least one of peripherals 202-210, without intervention by the user.

In some embodiments, UAV 206 may be located outdoors (e.g., on the roof of the structure). UAV 206 may be stored in a shelter (not shown in FIG. 2) which protects UAV 206 from exposure to the elements and which does not interfere with UAV's 206 flight capabilities. The shelter may include a charging system. For example, the shelter includes a wireless charging system, so that launch of UAV 206 may be performed without disconnecting charging wires. By way of further example, the shelter also includes a mechanism to facilitate launch (e.g., to move the UAV out of the shelter for launch, open the roof of the shelter to allow the UAV to achieve aerodynamic lift, etc.).

Speaker 207 may be a loudspeaker. Two or more of speaker 207 may be disposed in and/or about the structure for purposes such as structure wide music reproduction, audio effects (e.g., multichannel surround sound), and coverage for public address system (PA system). Base unit 120 and/or a home entertainment system (not shown in FIG. 2) may provide ambient music both inside (e.g., through ceiling mounted speakers) and outside (e.g., for music on patios, in pool areas, etc.) the structure. In some embodiments, audio from the base unit's 120 voice communications may be provided through one or more of (high quality) speaker 207. In conjunction with at least one of DECT phone 202 or smart phone 230 to provide a microphone (or an external microphone not shown in FIG. 2 connected to base unit 120) base unit 120 may use speaker 207 to provide a much higher quality speakerphone experience.

Speaker 207 may also be used in a manner similar to DECT phone 202 (e.g., to play announcements, messages, and to replace or augment alarm sirens), smoke alarm and/or carbon monoxide detector of sensor 203 (e.g., to replace or augment a separate alarm siren), and dedicated alarm sirens (not shown in FIG. 2) (e.g., to replace or augment a separate alarm siren).

Thermostat 208 senses an ambient temperature and controls a structure's heating and/or air conditioning system according to a desired temperature. Thermostat 208 may control the temperature of the structure according to a predetermined schedule, such as setting a lower temperature at night. Thermostat 208 may be a "smart" thermostat which, for example, learns when the structure is likely to be occupied and when it is likely to be empty (e.g., to automatically pre-heat or pre-cool the structure). Additionally or alternatively, more than one of thermostat 208 is disposed in the structure to control temperature in individual rooms or zones.

For example, thermostat 208 may include a motion sensor to determine occupancy and adjust temperature accordingly. In some embodiments, the thermostat is connected to base unit 120 via DECT ULE 220 (or other wireless communication). The motion sensor of thermostat 208 may be used as an additional sensor to detect intruders. In this way, a motion sensor of thermostat 208 provides the advantages of augmenting a separate motion sensor of sensor 203 and/or eliminating a separate motion sensor (and its associated costs, reducing the overall cost of the system). Additionally or alternatively, thermostat 208 may provide temperature information to base unit 120. In this way, dangerous conditions (e.g., high temperatures associated with a heat wave, fire, etc.) may be detected.

Baby monitor 210 includes audio and/or video sensors (e.g., microphone, video camera, etc.), for example to remotely monitor a baby from outside the baby's room. Baby monitor 210 may optionally include at least one of a night light, motion sensors (e.g., to sound an alarm if the baby stops moving for a predetermined amount of time), and night vision technology (e.g., infrared light emitting diodes and a charge-coupled device (CCD) sensor sensitive to infrared light) to enable viewing of a darkened room. When communicatively coupled to base unit 120, baby monitor 210 may also be used to provide audio or video for security monitoring, augmenting alert sounds, communicating with intruders etc., as described above.

Smart phone 230 is a mobile phone with more advanced computing capability and connectivity than, for example, basic feature phones. In some embodiments, smart phone 230 is one of computing device 110 (FIG. 1). As described herein, smart phone 230 may be used to monitor and control peripherals 202-210. For example, a web client (or other software application) on smart phone 230 may trigger actions designed to intimidate the intruder, include activating a siren (including those incorporated into sensors 203, DECT phones 202, speakers 207, baby monitors 210, etc.) in the house, by using actuators 203 to cause the lights to flash, lock doors, and the like. For example, such actions can performed using communications between base unit 120 and at least one peripheral 202-210, via DECT-ULE.

In various embodiments, smart phone 230 also serves a role similar to peripherals 202-210. For example, data from sensors (e.g., front and/or rear facing cameras, microphone(s), Global Positioning System (GPS) radio, WiFi modem, Bluetooth modem, etc.) of smart phone 230 is provided to base unit 120, received by base unit 120, and used by base unit 120 in a manner similar to peripherals 202-210, as described herein.

The present invention offers the user additional choices to respond to the intruder that leverages the VoIP capabilities of the server infrastructure. From his web or smartphone client, the user, upon determining that the intruder alert is valid, could initiate a 911 call as if it were originating from the house, rather than from the user's smartphone client. Normally a 911 call from a cell phone is directed to a public safety access point (PSAP) associated with the geographical location of the cell phone. For a user at a remote location who is alerted that his house is being invaded, dialing 911 from his cell phone would result in significant delay as he explains the situation to the PSAP serving the physical location of his smartphone (rather than that of the house that has been invaded), then waits for his call to be transferred to a PSAP in the area of his home and then takes the time to communicate the location of the house that is being invaded (which may even be in another state), and convinces the authorities to go to the invaded house. In the present invention, since the base unit in the house also provides VoIP service for the home, it is already provisioned to have its phone number associated with the appropriate physical address of the house. In the present invention, the user, operating his web or smartphone-based client, may initiate a 911 call from the user running the app as if it were originating from the invaded house. The call will then directly connect to the PSAP that is local to the invaded house, with the proper address electronically passed to the PSAP as if the call had originated from the invaded house, bypassing the delay of the earlier scenario.

As would readily be appreciated by one of ordinary skill in the art, various combinations and permutations of inputs from peripherals 202-210 are received by base unit 120, actions taken by base unit 120 based at least in part on the inputs, and options offered to a user via a software application on computing device 110 (FIG. 1) are possible. By way of example, water/moisture sensors alert the owner to possible leak situations via a smartphone interface on computing device 110, UAV 206 is dispatched to observe the impacted area. By way of further non-limiting example, similar responses are provided for alerts from freeze sensors, power failure sensors, humidity sensors, and numerous other sensors, again with embodiments to play announcements, contact the user, share on social media, dispatch a drone, etc.

Figure 3:
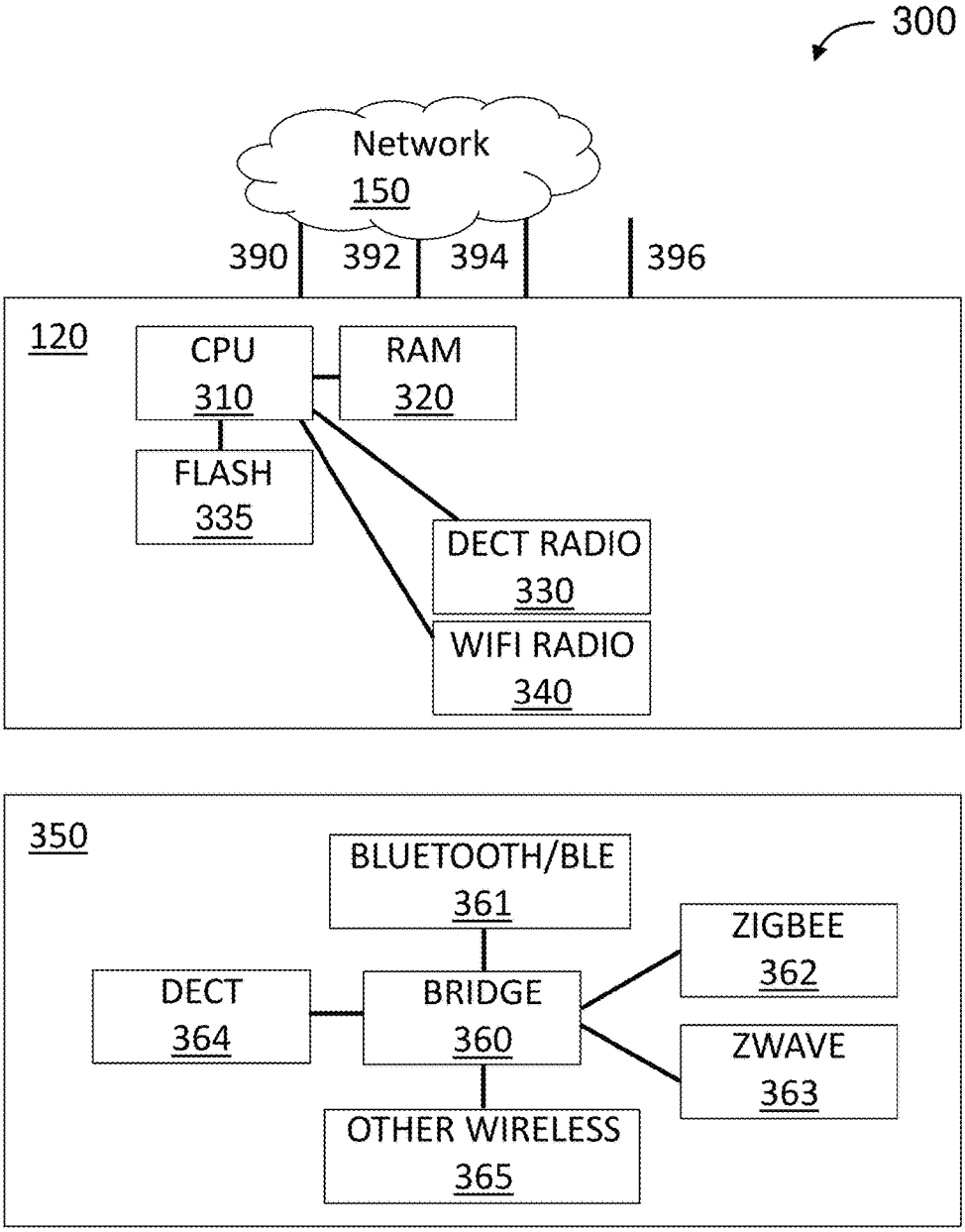
FIG. 3 is a simplified block diagram of an architecture for customer-premises equipment (CPE), according to some embodiments.

FIG. 3. illustrates a simplified architecture of customer-premises equipment (CPE) 300, according to some embodiments. CPE 300 includes at least one of base unit 120 and external bridge 350. In some embodiments, base unit 120 includes CPU 310, RAM 320, and Flash Storage 335. Additionally, base unit 120 may include at least one of DECT radio 330, WiFi Radio 340, and wired interfaces for Local Area Network (LAN) 390, Wide Area Network (WAN) 392, and FXS interface to the phone system 394, all shown communicatively coupled to network 150. Additionally, base unit 120 may include external USB connectivity (e.g., to peripherals as described in relation to FIGS. 2 and 13) via interface 396.

External bridge unit 350 includes bridge 360, which connects interfaces for one or more other protocols, for example, Bluetooth/BLE 361, ZigBee 362, ZWave 363, DECT 364 and other Wireless Interfaces 365. Bridge unit 350 may be connected to base unit 120 via one of the bridge interfaces 361-365 connecting to the base unit's WiFi Radio 340 or DECT Radio 330, via a USB connection from the base unit USB interface 396 to a USB connection on the bridge (not shown), via a wired network connection through network 150 to a wired connection on the bridge (not shown), or through another wired or wireless network connection.

Figure 4:
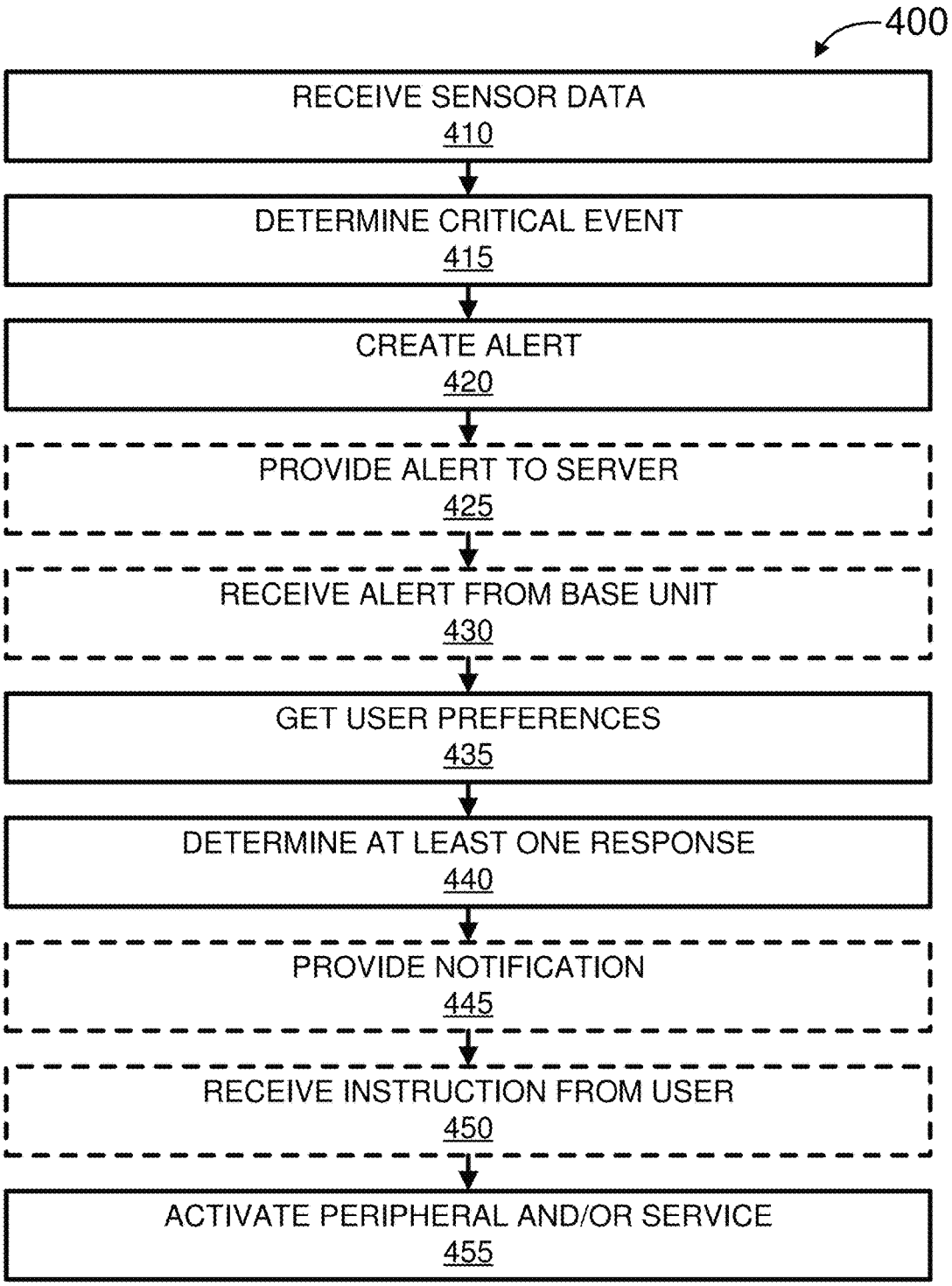
FIG. 4 is a simplified flow diagram for a method for responding to sensor data, according to some embodiments.

FIG. 4. shows a method 400 for operating base unit 120 (FIGS. 1 and 2) according to some embodiments. At step 410, sensor data is received from peripherals 202-210 by base unit 120. In some embodiments, sensor data is received from peripherals 202-210 (FIG. 2) through wired communications and/or wireless communications 220-225.

At step 415, a critical event such as an intruder entering the structure is determined from at least the received sensor data. For example, the intruder trips a motion sensor of sensor 203 which is interpreted as a critical event.

At step 420, an alert is created based at least on the critical event. For example, the alert includes information about the critical event (e.g., glass breakage detected in the family room, smoke detected in the kitchen, etc.)

At step 425, base unit 120 optionally provides the alert to server 160 (FIG. 1). For example, base unit 120 optionally sends the alert to server 160 through communications 144, network 150, and communications 148 (FIG. 1). In some embodiments where the apparatus and methods of server 160 are incorporated into base unit 120, the alert is not provided to server 160, but instead used internally by base unit 120.

At step 430, server 160 optionally receives the alert provided at step 425. In some embodiments where the apparatus and methods of server 160 are incorporated into base unit 120, the alert is not received by server 160, but instead used internally by base unit 120.

At step 435, user preferences associated with base unit 120 and/or a user of base unit 120 are retrieved (e.g., read from a database not shown in FIG. 2) and analyzed. At step 440, a response is determined based at least on the user preferences and the nature of the alert. For example, the determined response is to send a notification including a form of notification (e.g., send a notification through software application, SMS text message, etc.). At step 445, the notification is provided. For example, base unit 120 and/or server 160, after analyzing at least one of the sensor data, critical event, alert, and the user preferences, communicate the notification to a software application on computing device 110 (e.g., user's smartphone) through a push notification. In response to receiving the notification, the software application attracts the user's attention (e.g., providing an audible tone, flashing screen, etc.) and apprises the user of the situation at the structure (e.g., through at least one of displayed text, displayed graphics (including video), and audible tones and/or voice). As another example, the notification is an SMS text message sent to smart phone 230. In some embodiments, the software application is not used when the notifications are SMS text messages.

Steps 435-445 may be performed at base unit 120, server 160, and combinations thereof. In some embodiments where the apparatus and methods of server 160 are incorporated into base unit 120, steps 435-445 are performed by base unit 120.

The software application on computing device 110 may use data from a GPS radio to determine a present location. Based at least on the present location, the software application will process the alert. For example, in response to the software application determining the user is not presently in the structure (and therefore not under threat by a possible intruder), the software application displays the nature of the notification and presents multiple options for responding to the notification. The options presented to the user may be based in part on the capabilities of computing device 110 (smart phone, phablet, tablet computer, notebook computer, desktop computer, etc.), features supported by base unit 120 and/or server 160 (e.g., place telephone call, send an SMS text message, etc.), and availability of peripherals 202-210 (e.g., presence of siren, camera, etc.). The operation of computing device 110 and software application are described further in relation to FIG. 5.

At step 450, optionally an instruction is received. For example, the software application on computing device 110 may send an instruction generated based at least on a user selection from options presented. In some embodiments, a predetermined course of action may be taken (automatically without receipt of the instruction) in response to a particular determined critical event.

At step 455, a peripheral and/or service is activated. As described in greater detail herein, peripherals and/or services such as an internal and/or external siren, lighting (e.g., flash, turn on, and turn off), audible and/or visual alarm in a smoke detector, a personal surveillance drone, door locks, window coverings (e.g., open, close, and trim), postings to social media, and the like may be controlled or performed. In some embodiments where instructions are not received from the user, the activation may be automatic and/or based on the determined response (step 440).

Figure 5:
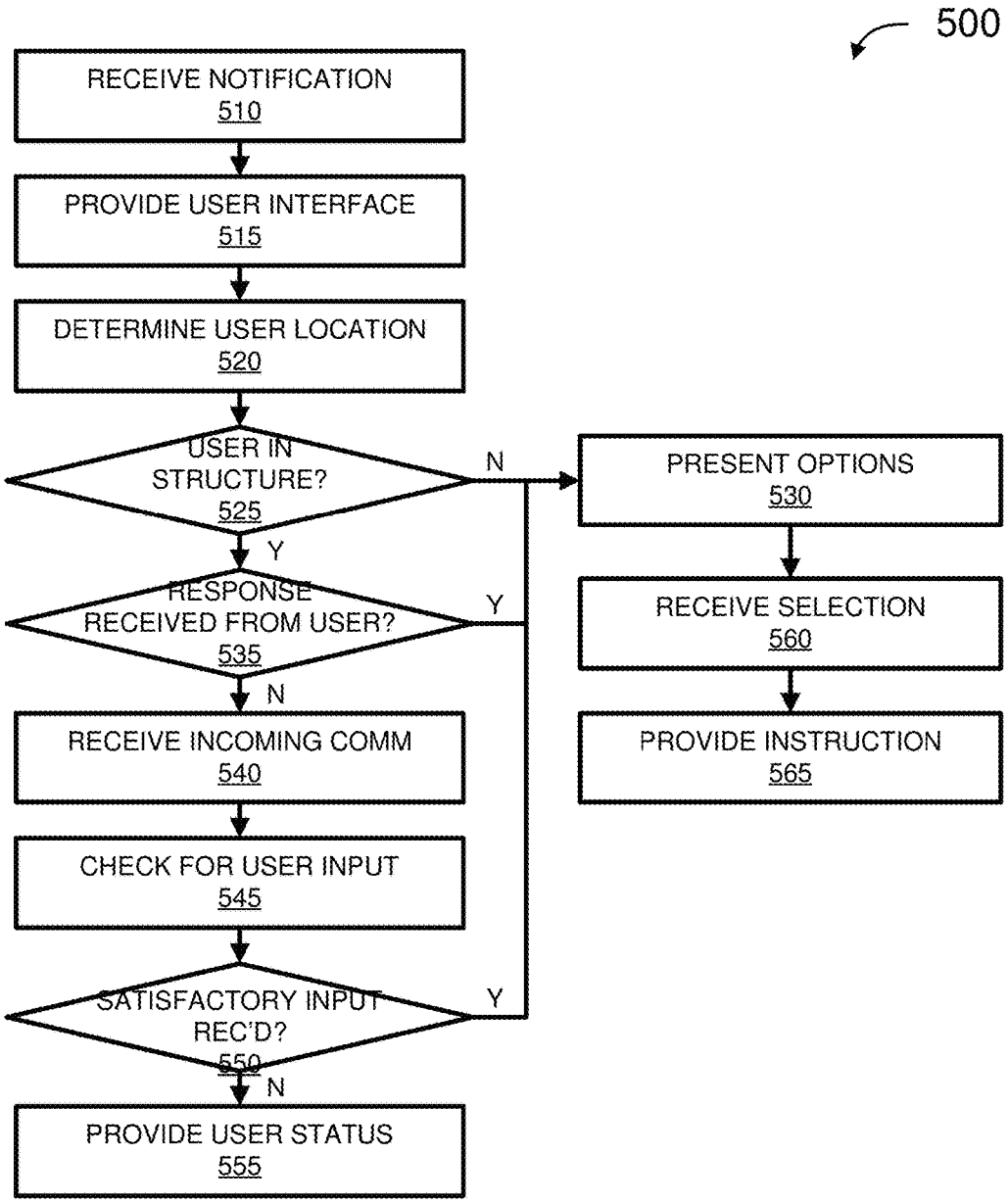
FIG. 5 is a simplified flow diagram for a method for responding to a notification, according to some embodiments.

FIG. 5. depicts a method 500 for operating computing device 110 (FIG. 1) according to various embodiments. At step 510 a notification is received. For example, a response is determined and a notification provided by base unit 120 (steps 440 and 445 in FIG. 4) is received by computing device 110. The notification may include information about the critical event At step 515, a user interface is provided by computing device 110, for example, in response to receipt of the notification. In some embodiments, the user interface at least notifies the user graphically and/or textually that a notification has been received. For example, the software application launches its user interface and offers the user the opportunity to activate a menu of alert responses (i.e., choices).

At step 520, a location of computing device 110 (and hence a user of computing device 110) is determined, for example, based in part on information received from a GPS radio of computing device 110.

At step 525, the presence of the user in the structure is evaluated based on the determined location. For example, if the client software application determines that the user is physically in the structure where the intruder has been detected, then it is possible that the user is not in a safe position to interact with the software application. In response to the user not being in the structure, the method proceeds to step 530. In response to the user being in the structure, the method proceeds to step 535.

At step 535, a reaction from the user responsive to the user interface is evaluated. For example, when the user does not respond (no response) to the appearance of the user interface and/or opportunity to activate the menu of alert responses, then the user may not be free to operate the software application (e.g., since he may be in dangerous proximity to the intruder). In response to the user responding, the method proceeds to step 530. In response to the user not responding, the method proceeds to step 540.

At step 540, an incoming communication (e.g., telephone call, text message, email, etc.) from base unit 120 and/or server 160 is received. For example, when the user does not respond to the user interface, the software application sends a message to base unit 120 and/or server 160 that causes a call to be placed to the smartphone. In some embodiments, the incoming call may verbally ask a challenge question for at least one of a keyword, key phrase, personal identification number (PIN), and the like to cancel alarm condition (e.g., the alert).

At step 545, user input is received. User input is, for example, a verbal response to the challenge question or no response. At step 550, the user input (or lack thereof) is evaluated to determine if the user input is satisfactory. For example, satisfactory input is the expected predetermined keyword, key phrase, or personal identification number (PIN). For example, unsatisfactory input is when the user does not answer the call (no response), the user fails to respond to the call with the proper keyword or PIN to disable the monitoring system, the user responds with a pre-arranged panic keyword or PIN, and the like. In response to the user providing a satisfactory response, the method proceeds to step 530. In response to the user not providing a satisfactory response, the method proceeds to step 555.

At step 555, a user status is provided to base unit 120 and/or server 160. For example, a user status indicates the user did not provide a satisfactory response. In response to receipt of the user status, base unit 120 and/or server 160 may be programmed to presume the user is under duress or otherwise in danger. For example, base unit 120 and/or server 160 may initiate a 911 call originating from the structure's address. The 911 call placed may have an automated message that describes the situation (e.g., based on sensor data, critical event, lack of user response, etc.), so that authorities can have the best opportunity to safely handle the situation, even when the user himself is not in a safe position to speak with the authorities. In this way, the user is given ample opportunity to disable the alarm condition (e.g., alert), but not at the expense of ultimately notifying the authorities.

At step 530, options are presented. For example, computing device 110 may present a menu of alert responses. Alert responses may include activating the microphone in one or more of DECT phone 202, hit a (virtual) "panic button," and the like. Further examples of alert response are described above.

At step 560, a selection from the alert responses is received from the user.

At step 565, an instruction associated with the received selection is provided to base unit 120 and/or server 160. For example, if the user hits the virtual panic button, then an instruction to initiate a 911 call is sent to base unit 120 and/or server 160.

In the absence of communication with the user or lack of response from the user at any stage, pre-programmed actions may be determined and performed by the base unit 120 or the server 160.

Figure 6:
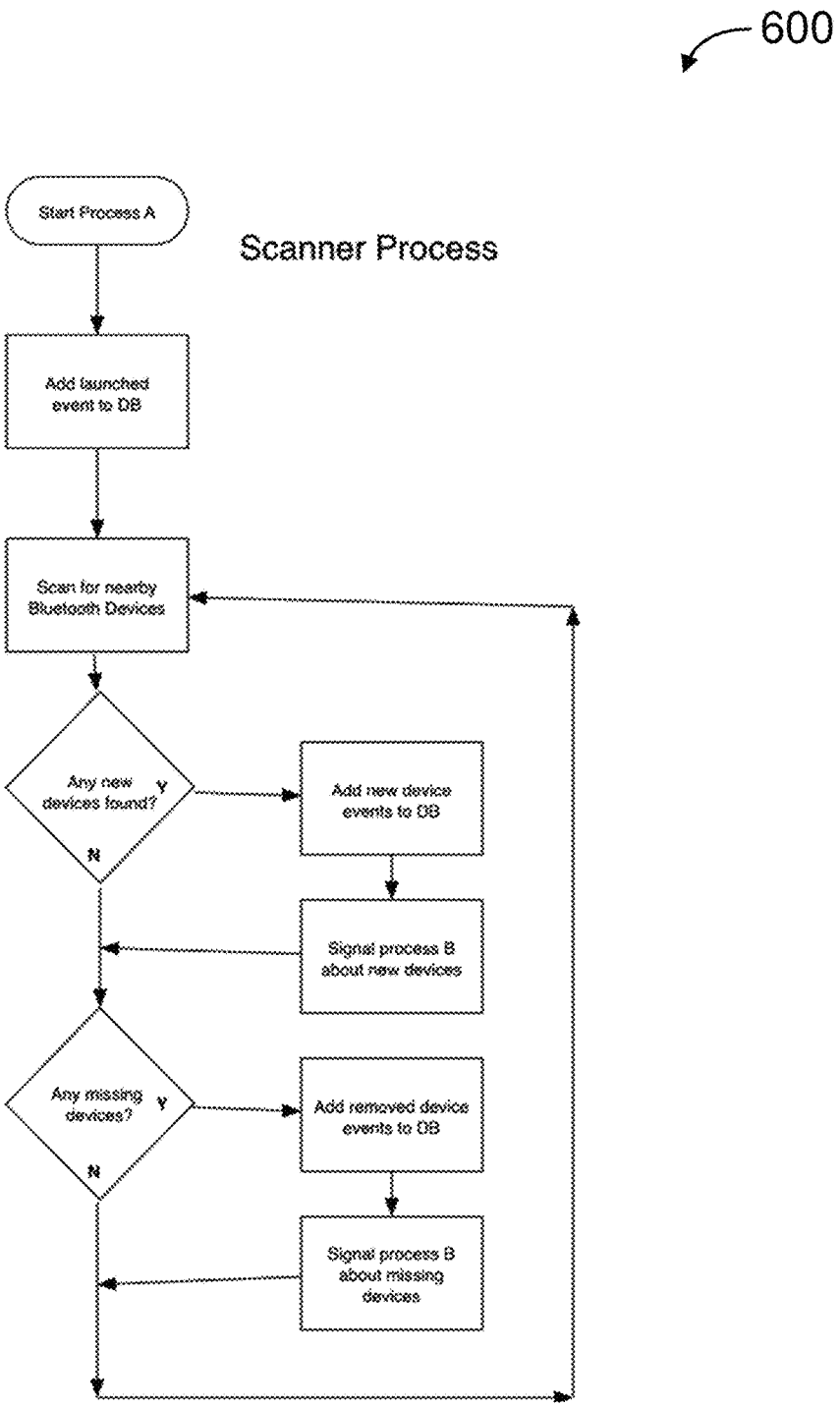
FIGS. 6-12 are simplified flow diagrams for wireless methods according to some embodiments.
Figure 7:
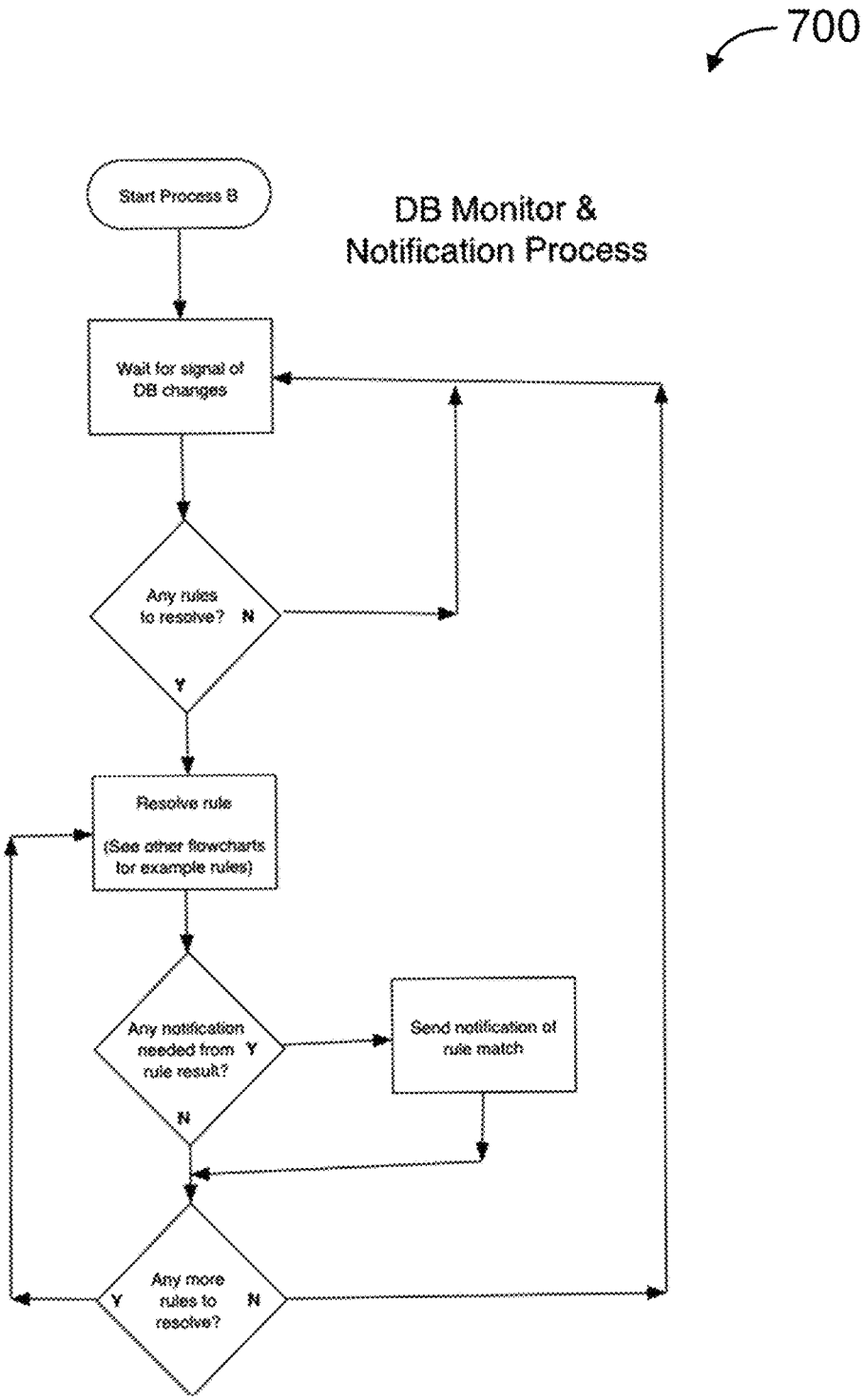
Figure 8:
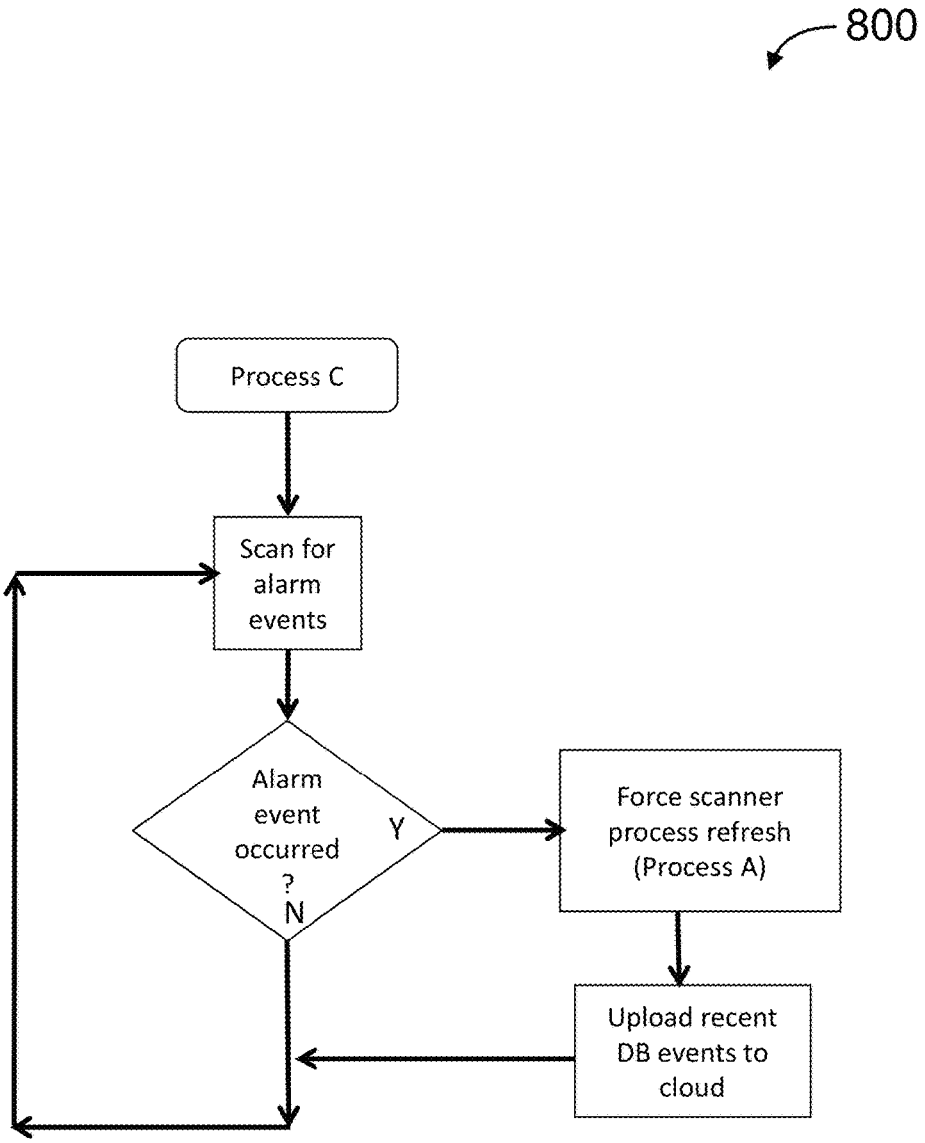
Figure 9:
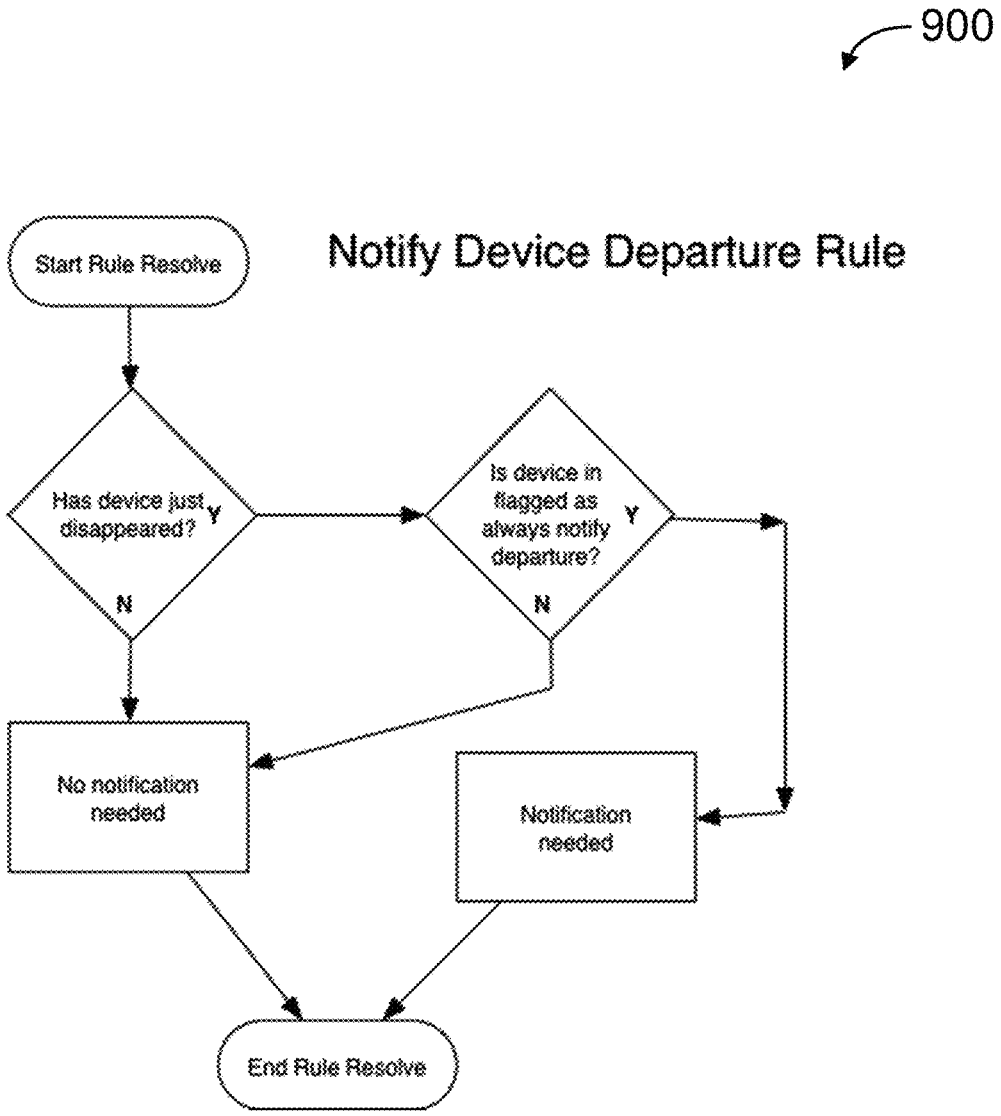
Figure 10:
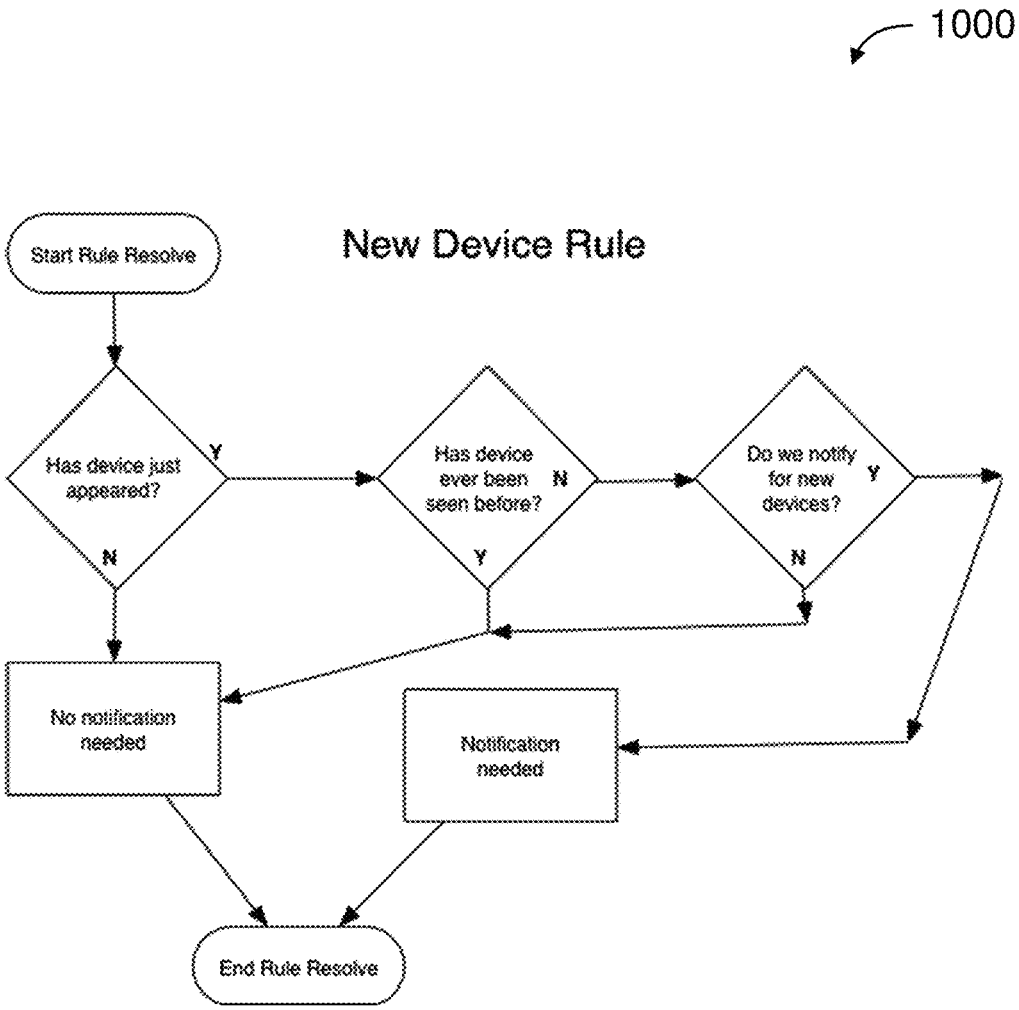
Figure 11:
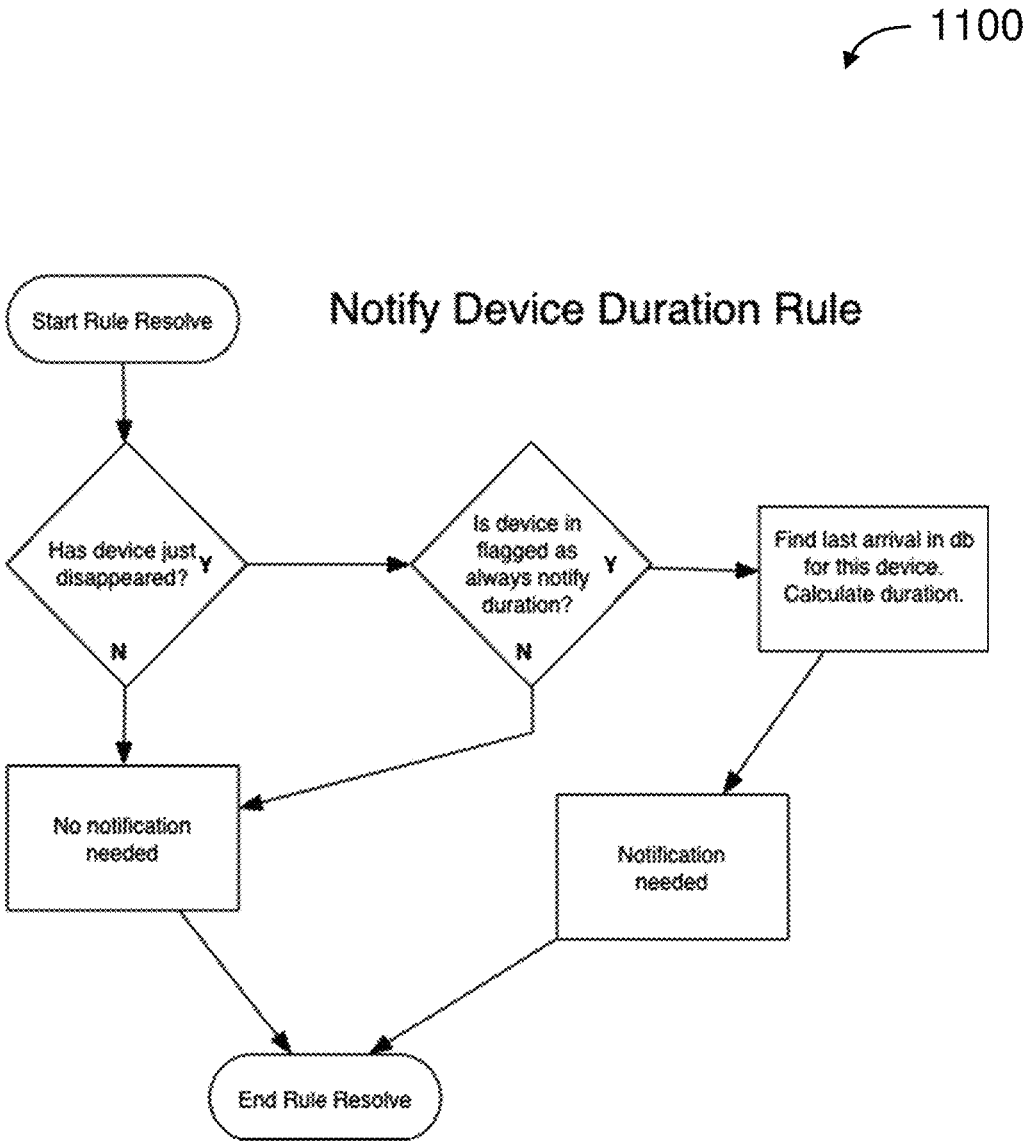
Figure 12:
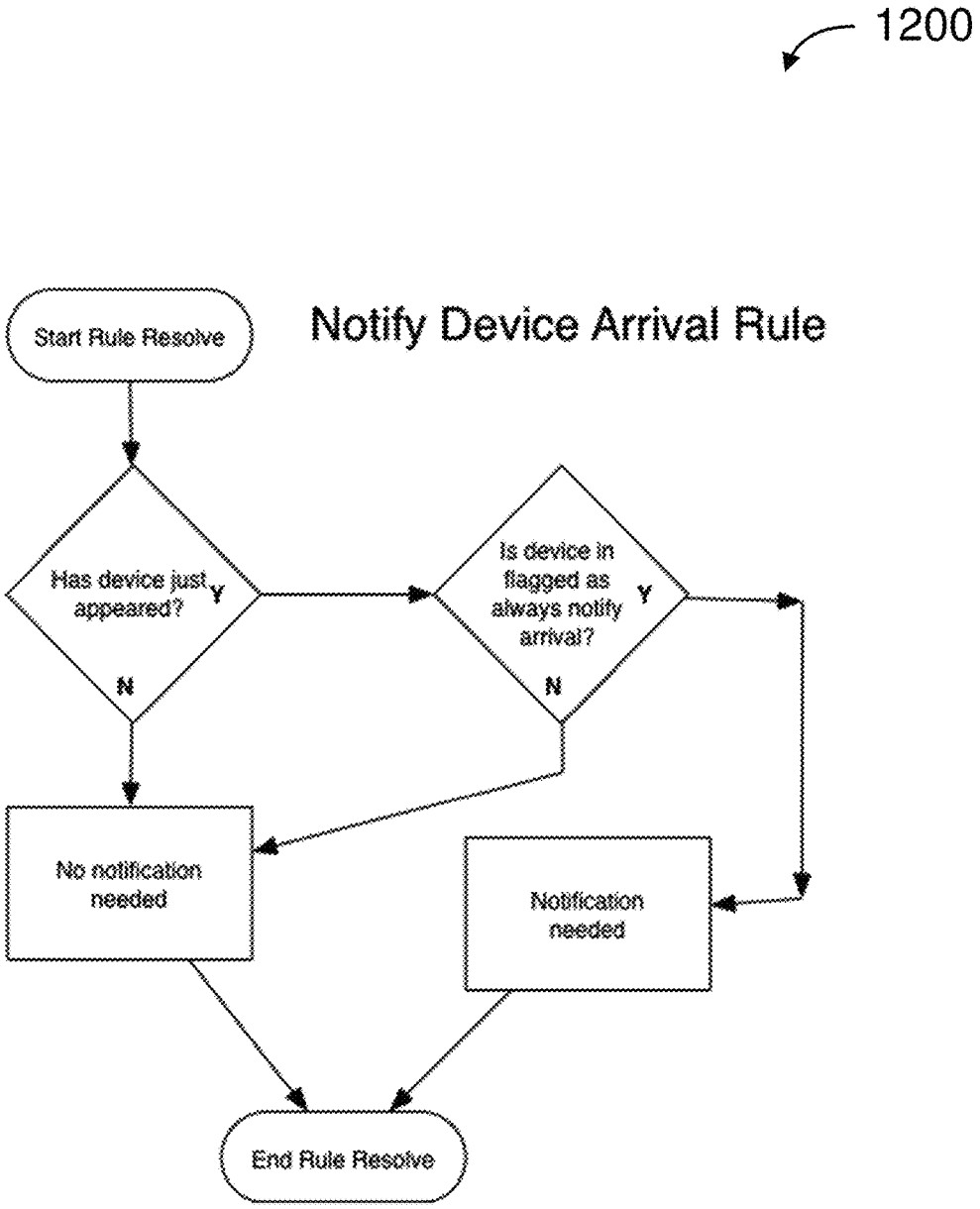

FIGS. 6-12 illustrate methods for wireless operation according to various embodiments. FIG. 6 illustrates the process 600 of monitoring for devices in range of the various network interfaces 220-225 (in the example Bluetooth 223) and taking actions. FIG. 7 illustrates the process 700 for one embodiment of actions based on rules taken in response to the various connected devices. FIG. 8 illustrates a mechanism 800 an embodiment could use to force scanning and record events, then push them to the cloud in the case of an alarm event. FIG. 9 illustrates a process 900 for an embodiment where notifications are generated as various devices 230 and 240 enter the range of various network interfaces 220-225. FIG. 10 illustrates a mechanism 1000 an embodiment might use to process actions in response to a new device 230 or 240, not previously seen, entering the range of one of the various network interfaces 220-225. FIG. 11 illustrates a process 1100 for one embodiment where notifications are generated based on the time that a device 230 or 240 is detected as being in range to one of various network interfaces 220-225. FIG. 12 illustrates the process 1200 used by one embodiment to generate an alert when a particular "flagged" device 230 or 240 is detected to have come within range of one of the various network interfaces 220-225. These figures are provided by way of example and not limitation.

Figure 13:
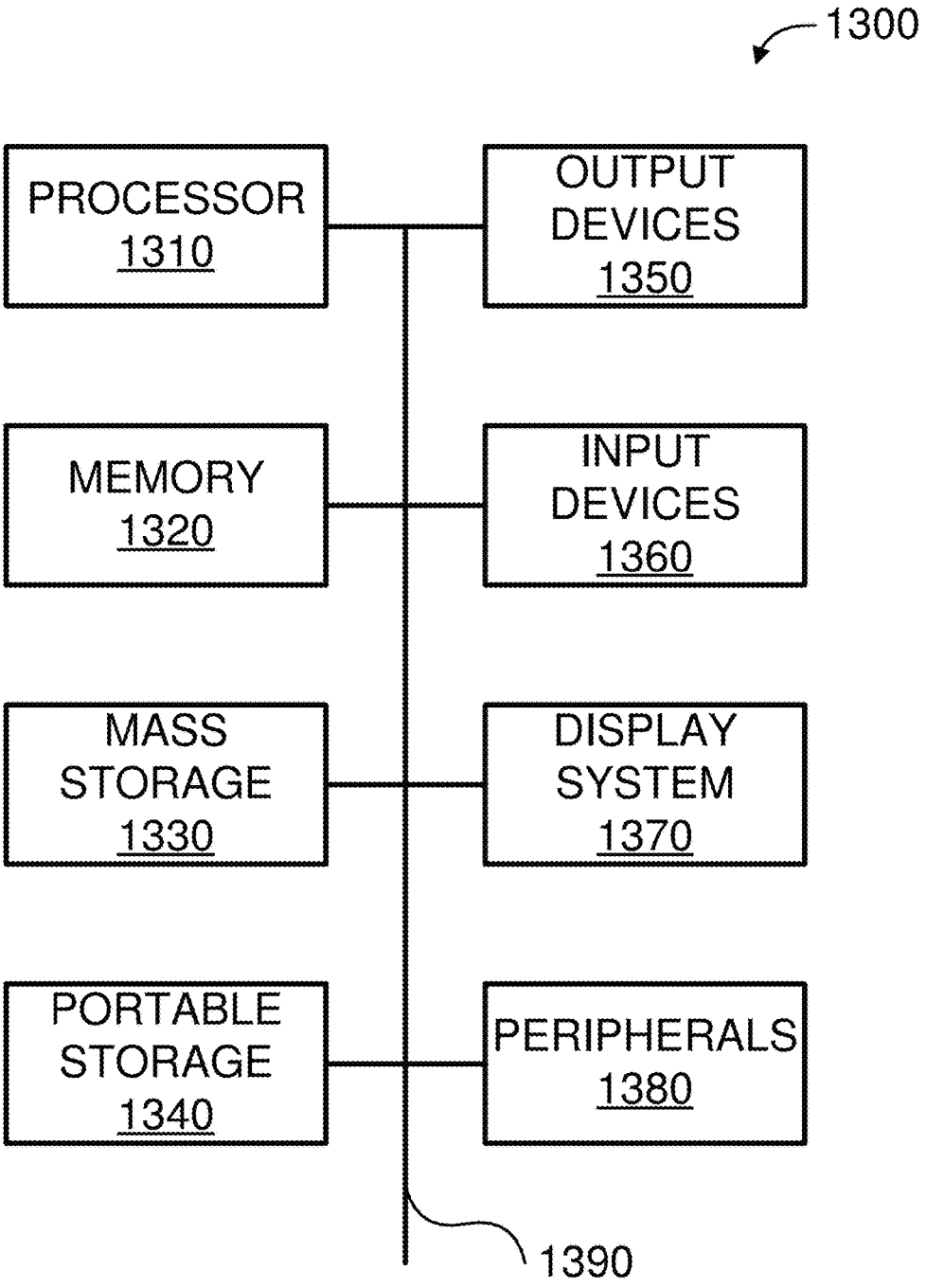
FIG. 13 is a simplified block diagram for a computing system according to some embodiments.

FIG. 13 illustrates an exemplary computing system 1300 that is used to implement some embodiments of the present systems and methods. The computing system 1300 of FIG. 13 is implemented in the contexts of the likes of computing devices, networks, webservers, databases, or combinations thereof. The computing device 1300 of FIG. 13 includes a processor 1310 and memory 1320. Memory 1320 stores, in part, instructions and data for execution by processor 1310. Memory 1320 stores the executable code when in operation. The computing system 1300 of FIG. 13 further includes a mass storage 1330, portable storage 1340, output devices 1350, input devices 1360, a display system 1370, and peripherals 1380. The components shown in FIG. 13 are depicted as being connected via a single bus 1390. The components are connected through one or more data transport means. Processor 1310 and memory 1320 may be connected via a local microprocessor bus, and the mass storage 1330, peripherals 1380, portable storage 1340, and display system 1370 may be connected via one or more input/output (I/O) buses.

Mass storage 1330, which may be implemented with a magnetic disk drive, solid-state drive (SSD), or an optical disk drive, is a non-volatile storage device for storing data and instructions for use by processor 1310. Mass storage 1330 can store the system software for implementing embodiments of the present technology for purposes of loading that software into memory 1320.

Portable storage 1340 operates in conjunction with a portable non-volatile storage medium, such as a floppy disk, compact disk or digital video disc, to input and output data and code to and from the computing system 1300 of FIG. 13. The system software for implementing embodiments of the present technology may be stored on such a portable medium and input to the computing system 1300 via the portable storage 1340. Portable storage 1340 operates in conjunction with a portable non-volatile storage medium, such as a floppy disk, compact disk or digital video disc, to input and output data and code to and from the computing system 1300 of FIG. 13. The system software for implementing embodiments of the present technology may be stored on such a portable medium and input to the computing system 1300 via the portable storage 1340.

Input devices 1360 provide a portion of a user interface. Input devices 1360 may include an alphanumeric keypad, such as a keyboard, for inputting alphanumeric and other information, or a pointing device, such as a mouse, a trackball, stylus, or cursor direction keys. Additionally, the system 1300 as shown in FIG. 13 includes output devices 1350. Suitable output devices include speakers, printers, network interfaces, and monitors.

Display system 1370 includes a liquid crystal display (LCD) or other suitable display device. Display system 1370 receives textual and graphical information, and processes the information for output to the display device.

In addition to peripherals 102-107 (FIG. 2), peripherals 1380 may include any type of computer support device to add additional functionality to the computing system. Peripherals 1380, for example, include a modem and/or a router.

The components contained in the computing system 1300 of FIG. 13 are those typically found in computing systems that may be suitable for use with embodiments of the present technology and are intended to represent a broad category of such computer components that are well known in the art. Thus, the computing system 1300 can be a personal computer, hand held computing system, telephone, mobile phone, smartphone, tablet, phablet, wearable technology, mobile computing system, workstation, server, minicomputer, mainframe computer, or any other computing system. The computer can also include different bus configurations, networked platforms, multi-processor platforms, etc. Various operating systems can be used including UNIX, LINUX, WINDOWS, MACINTOSH OS, IOS, ANDROID, CHROME, and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the technology. Those skilled in the art are familiar with instructions, processor(s), and storage media.

In some embodiments, the computing system 1300 may be implemented as a cloud-based computing environment, such as a virtual machine operating within a computing cloud. In other embodiments, the computing system 1300 may itself include a cloud-based computing environment, where the functionalities of the computing system 1300 are executed in a distributed fashion. Thus, the computing system 1300, when configured as a computing cloud, may include pluralities of computing devices in various forms, as will be described in greater detail below.

In general, a cloud-based computing environment is a resource that typically combines the computational power of a large grouping of processors (such as within web servers) and/or that combines the storage capacity of a large grouping of computer memories or storage devices. Systems that provide cloud-based resources may be utilized exclusively by their owners or such systems may be accessible to outside users who deploy applications within the computing infrastructure to obtain the benefit of large computational or storage resources.

The cloud is formed, for example, by a network of web servers that comprise a plurality of computing devices, such as the computing system 1300, with each server (or at least a plurality thereof) providing processor and/or storage resources. These servers manage workloads provided by multiple users (e.g., cloud resource customers or other users). Typically, each user places workload demands upon the cloud that vary in real-time, sometimes dramatically. The nature and extent of these variations typically depends on the type of business associated with the user.

It is noteworthy that any hardware platform suitable for performing the processing described herein is suitable for use with the technology. The terms "computer-readable storage medium" and "computer-readable storage media" as used herein refer to any medium or media that participate in providing instructions to a CPU for execution. Such media can take many forms, including, but not limited to, non-volatile media, volatile media and transmission media. Non-volatile media include, for example, optical, magnetic, and solid-state disks, such as a fixed disk. Volatile media include dynamic memory, such as system RAM. Transmission media include coaxial cables, copper wire and fiber optics, among others, including the wires that comprise one embodiment of a bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, any other magnetic medium, a CD-ROM disk, digital video disk (DVD), any other optical medium, any other physical medium with patterns of marks or holes, a RAM, a PROM, an EPROM, an EEPROM, a FLASH memory, any other memory chip or data exchange adapter, a carrier wave, or any other medium from which a computer can read.

Various forms of computer-readable media may be involved in carrying one or more sequences of one or more instructions to a CPU for execution. A bus carries the data to system RAM, from which a CPU retrieves and executes the instructions. The instructions received by system RAM can optionally be stored on a fixed disk either before or after execution by a CPU.

Computer program code for carrying out operations for aspects of the present technology may be written in any combination of one or more programming languages, including an object oriented programming language such as JAVA, SMALLTALK, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the invention in the form disclosed. Many modifications and variations will be apparent to those of ordinary skill in the art without departing from the scope and spirit of the invention. Exemplary embodiments were chosen and described in order to best explain the principles of the present technology and its practical application, and to enable others of ordinary skill in the art to understand the invention for various embodiments with various modifications as are suited to the particular use contemplated.

Aspects of the present technology are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present technology. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the present technology has been described in connection with a series of preferred embodiment, these descriptions are not intended to limit the scope of the technology to the particular forms set forth herein. It will be further understood that the methods of the technology are not necessarily limited to the discrete steps or the order of the steps described. To the contrary, the present descriptions are intended to cover such alternatives, modifications, and equivalents as may be included within the spirit and scope of the technology as defined by the appended claims and otherwise appreciated by one of ordinary skill in the art.

What is claimed is:

1. A method for security monitoring and control comprising:

receiving sensor data from at least one first peripheral, the sensor data associated with at least one of activity inside and activity outside of a structure;

determining a critical event based in part on the sensor data;

creating an alert based in part on the critical event;

getting user preferences associated with at least one of a user and a base unit;

determining a response based in part on the alert and the user preferences; and activating a second peripheral based in part on the response, the second peripheral including an unmanned aircraft, and the activating the second peripheral including:

sending the unmanned aircraft to an area of interest, the area of interest determined based at least on the critical event;

sensing at least one of video and audio, the sensing using at least one of video and audio sensors disposed on the unmanned aircraft; and providing the at least one of video and audio.

2. The method of claim 1 wherein the first peripheral includes at least one of a cordless phone, door/gate sensor, window sensor, glass breakage sensor, flood sensor, pool sensor, and baby monitor.

3. The method of claim 1 further comprising:

providing the alert to a server, wherein the user preferences are received from the server.

4. The method of claim 1 further comprising:

providing a notification to the user based at least on the response; and receiving instructions from the user, wherein the activating is further based on the instructions.

5. The method of claim 1 further comprising:

detecting a wireless device associated with an intruder; and determining one or more properties of the wireless device, the determining including detecting a digital fingerprint of the wireless device.

6. The method of claim 5 wherein the wireless device is a Bluetooth enabled device in discoverable mode, and the determining one or more properties further includes at least one of executing software on, sending a chunk of data to, or sending a sequence of commands to the Bluetooth enabled device, so as to gain control of the Bluetooth enabled device.

7. The method of claim 1 wherein the second peripheral further includes at least one cordless phone, and the activating the second peripheral further includes:

silently turning on a microphone of the at least one cordless phone;

sensing audio using the microphone; and providing the audio.

8. The method of claim 7 wherein the activating the second peripheral further includes playing a selected recorded announcement using a speaker of the at least one cordless phone, the selection of the recorded announcement based at least on the response.

9. The method of claim 1 further comprising:

activating a service based in part on the response, the activating the service including posting to social media to alert neighbors based at least on the response.

10. A base unit comprising:

a processor; and a memory coupled to the processor, the memory storing instructions executable by the processor to perform a method for security monitoring and control including:

receiving sensor data from at least one first peripheral, the sensor data associated with at least one of activity inside and activity outside of a structure;

determining a critical event based in part on the sensor data;

creating an alert based in part on the critical event;

getting user preferences associated with at least one of a user and a base unit;

determining a response based in part on the alert and the user preferences; and activating a second peripheral based in part on the response, the second peripheral including an unmanned aircraft, and the activating the second peripheral including:

sending the unmanned aircraft to an area of interest, the area of interest determined based at least on the critical event;

sensing at least one of video and audio, the sensing using at least one of video and audio sensors disposed on the unmanned aircraft; and providing the at least one of video and audio.

11. The base unit of claim 10 wherein the first peripheral includes at least one of a cordless phone, door/gate sensor, window sensor, glass breakage sensor, flood sensor, camera, smart thermostat, pool sensor, and baby monitor.

12. The base unit of claim 10 wherein the method further comprises:

providing the alert to a server, wherein the user preferences are received from the server.

13. The base unit of claim 10 wherein the method further comprises:

providing a notification to the user based at least on the response; and receiving instructions from the user, wherein the activating is further based on the instructions from the user.

14. The base unit of claim 10 wherein the method further comprises:

detecting a wireless device associated with an intruder; and determining properties of the wireless device.

15. The base unit of claim 14 wherein the wireless device is a Bluetooth enabled device in discoverable mode, and the determining properties includes at least one of executing software on, sending a chunk of data to, or sending a sequence of commands to the Bluetooth enabled device, so as to gain control of the Bluetooth enabled device.

16. The base unit of claim 10 wherein the second peripheral further includes at least one cordless phone, and the activating the second peripheral further includes:

silently turning on a microphone of the at least one cordless phone;

sensing audio using the microphone; and providing the audio.

17. The base unit of claim 16 wherein the activating the second peripheral further includes playing a selected recorded announcement using a speaker of the at least one cordless phone, the selection of the recorded announcement based at least on the response.

18. The base unit of claim 10 wherein the method further comprises:

activating a service based in part on the response, the activating the service including posting to social media to alert neighbors based at least on the alert.

* * * * *